US007822356B2

(12) United States Patent
Sakagawa et al.

(10) Patent No.: US 7,822,356 B2
(45) Date of Patent: Oct. 26, 2010

(54) IMAGE FORMING APPARATUS

(75) Inventors: Yoshio Sakagawa, Hyogo (JP); Tetsumaru Fujita, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 377 days.

(21) Appl. No.: 12/020,089

(22) Filed: Jan. 25, 2008

(65) Prior Publication Data

US 2008/0181655 A1 Jul. 31, 2008

(30) Foreign Application Priority Data

Jan. 31, 2007 (JP) ..... 2007-021925

(51) Int. Cl.
*G03G 15/16* (2006.01)

(52) U.S. Cl. ..... 399/101; 399/71; 399/99; 399/354

(58) Field of Classification Search ..... 399/71, 399/91, 98–100, 110, 115, 101, 353, 354, 399/50, 308

See application file for complete search history.

(56) References Cited

U.S. PATENT DOCUMENTS

| | | | | |
|---|---|---|---|---|
| 4,185,910 | A * | 1/1980 | Nomura et al. | 399/354 |
| 5,864,741 | A * | 1/1999 | Montfort et al. | 399/349 |
| 5,923,939 | A * | 7/1999 | Koyama | 399/308 |
| 2002/0141771 | A1* | 10/2002 | Nishimura | 399/50 |
| 2003/0091364 | A1* | 5/2003 | Nishiwaki | 399/101 |
| 2005/0232668 | A1* | 10/2005 | Shida | 399/354 |
| 2006/0083539 | A1* | 4/2006 | Nishikawa | 399/101 |
| 2007/0014605 | A1* | 1/2007 | Facci et al. | 399/346 |
| 2007/0065179 | A1 | 3/2007 | Fujita | |
| 2007/0172259 | A1 | 7/2007 | Fujita | |
| 2007/0280735 | A1 | 12/2007 | Nagatomo et al. | |
| 2009/0041491 | A1 | 2/2009 | Shono et al. | |
| 2009/0067887 | A1 | 3/2009 | Fujita et al. | |
| 2009/0311002 | A1* | 12/2009 | Shibuya et al. | 399/101 |

FOREIGN PATENT DOCUMENTS

JP 2003-316130 11/2003

* cited by examiner

*Primary Examiner*—David P Porta
*Assistant Examiner*—Jessica L Eley
(74) *Attorney, Agent, or Firm*—Oblon, Spivak, McClelland, Maier & Neustadt, L.L.P.

(57) ABSTRACT

The present invention provides an image forming apparatus in which the cleaning performance of a cleaning brush is preserved over time while affording a smaller apparatus main body. During a print job, toner recovered from a charging roller to a cleaning brush is transferred from the cleaning brush to a cleaning auxiliary roller, thereby preventing excessive accumulation of toner in the cleaning brush. During non print job times, toner accumulated in the cleaning brush is transferred to the charging roller directly and via the cleaning auxiliary roller, whereby the cleaning brush becomes clean while preserving its cleaning performance. Also, toner transferred to the charging roller is transferred to a photosensitive unit is recovered into a developing device, which does away with the need for a dedicated recovery toner holding portion for recovering residual toner, thereby reducing the size of the apparatus main body.

14 Claims, 13 Drawing Sheets

CHART HORIZONTAL STRIPES 50% CHART 100 SHEETS

FIG. 15

| LINEAR SPEED RATIO | 0.05 | 0.1 | 0.5 | 0.9 | 1.5 | 2.5 |
|---|---|---|---|---|---|---|
| LINEAR SPEED OF CLEANING BRUSH [mm/s] | 5 | 10 | 50 | 90 | 150 | 250 |
| DUMPING RATE [%] | 5 | 50 | 30 | 15 | 5 | 5 |

FIG. 16

| CHARGING MEMBER | CLEANING MEMBER | CLEANING AUXILIARY MEMBER | BIAS [V] | | | | | | EVALUATION | |
|---|---|---|---|---|---|---|---|---|---|---|
| | | | PRINT JOB | | | NON-PRINT JOB | | | CONTIN-UOUS 10,000 SHEET PRINTING | CONTIN-UOUS 50,000 SHEET PRINTING |
| | | | CHARGING MEMBER | CLEANING MEMBER | CLEANING AUXILIARY MEMBER | CHARGING MEMBER | CLEANING MEMBER | CLEANING AUXILIARY MEMBER | | |
| CHARGING ROLLER | CLEANING BRUSH | METAL ROLLER | −500 | −900 | −600 | −800 | −1500 | −900 | ○ | △ |
| CHARGING ROLLER | CLEANING BRUSH | NONE | −500 | −900 | – | −800 | −1500 | – | × | × |
| CHARGING ROLLER | CLEANING BRUSH | METAL ROLLER | −400 | −1000 | −500 | −700 | −1600 | −900 | ○ | ○ |
| CHARGING ROLLER | CLEANING BRUSH | METAL ROLLER | −500 | −900 | −600 | −800 | −1500 | −900 | ○ | ○ |

IMAGE FORMING APPARATUS

BACKGROUND OF THE INVENTION

1. Field of the Invention

The present invention relates to an image forming apparatus such as a printer, a copier, a fax machine or the like, and more particularly to an image forming apparatus in which a cleaning member cleans transfer residual toner adhering to the surface of a charging member that charges a carrier.

2. Description of the Related Art

Known conventional image forming apparatuses include apparatuses in which a photosensitive element is charged through contact of the surface of the photosensitive element with a charging roller to which voltage is applied. Since the charging roller comes thus into contact with the photosensitive element, toner remaining on the surface of the photosensitive element, after cleaning of the photosensitive element surface by a cleaning brush or the like, becomes adhered to the surface of the charging roller. When toner becomes thus adhered to the surface of the charging roller, the photosensitive element cannot be appropriately charged at the portions where toner is adhered, which gives rise to non-uniform charging of the photosensitive element surface. The toner adhered to the surface of the charging roller must therefore be removed.

In the image forming apparatus described in, for instance, Japanese Unexamined Patent Application Laid-open No. 2003-316130, comprising two or more cleaning brushes for cleaning a charging roller, at least one of the cleaning brushes does not come into contact with the charging roller while the remaining cleaning brushes do so, to remove thereby toner adhered to the surface of the charging roller.

When the cleaning brush removes toner adhered to the surface of the charging roller, toner accumulates gradually on the cleaning brush, eventually impairing the cleaning performance of the cleaning brush. When its cleaning performance becomes impaired, the cleaning brush fails to clean the charging roller well, which gives rise, as described above, to non-uniform charging of the photosensitive element surface.

In the image forming apparatus described in Japanese Unexamined Patent Application Laid-open No. 2003-316130, as a result, the charging roller can be charged well by switching a cleaning brush having lessened cleaning performance to a cleaning brush having no lessened cleaning performance, for instance when the surface potential of the photosensitive element is reduced. The toner accumulated in the cleaning brush with lessened cleaning performance is knocked off by a knocking member, to restore thereby the cleaning performance of the cleaning brush with lessened cleaning performance.

However, the following problems arise in the image forming apparatus described in Japanese Unexamined Patent Application Laid-open No. 2003-316130. Specifically, cleaning of the charging roller by the cleaning brush is deficient immediately prior to cleaning brush switching, and hence there occurs non-uniform charging of the surface of the photosensitive element by the charging roller immediately prior to the above switching. As a result, an image formed on the photosensitive element that is charged immediately prior to the above switching exhibits, for instance, uneven density during printing, when the surface potential of the photosensitive element decreases. Moreover, there must be provided a waste toner tank or the like for recovering the toner knocked off the cleaning brush, which entails a larger size of the apparatus main body that accommodates such a waste toner tank.

SUMMARY OF THE INVENTION

In light of the above, it is an object of the present invention to provide an image forming apparatus in which the cleaning performance of a cleaning brush is preserved over time while affording a smaller apparatus main body.

In an aspect of the present invention, an image forming apparatus comprises a latent image carrier configured to carry a latent image on an endlessly moving surface thereof; a developing device configured to develop with toner a latent image on the latent image carrier; a charging member configured to uniformly charge a surface of the latent image carrier while the surface thereof in contact with the latent image carrier is moved endlessly; a first bias supply device configured to supply bias to the charging member; a first cleaning member configured to clean a surface of the charging member by recovering at least toner adhered to the surface of the charging member while the surface thereof in contact with the latent charging member is moved endlessly; a second bias supply device configured to supply bias to the first cleaning member; a second cleaning member configured to recover toner at least from the first cleaning member while the surface thereof in contact with the charging member and the first cleaning member is moved endlessly; and a third bias supply device configured to supply bias to the second cleaning member. The first bias supply device supplies bias to the charging member, and the third bias supply device supplies bias to the second cleaning member, in such a way that toner recovered in the second cleaning member is transferred by electrostatic forces to the charging member, to transfer thereby toner from the second cleaning member to the charging member. The first bias supply device supplies bias to the charging member and the second bias supply device supplies bias to the first cleaning member in such a way that toner recovered in the first cleaning member is transferred by electrostatic forces, from the first cleaning member directly to the charging member, to transfer thereby toner from the first cleaning member to the charging member, and/or the first bias supply device supplies bias to the charging member, the second bias supply device supplies bias to the first cleaning member, and the third bias supply device supplies bias to the second cleaning member in such a way that toner is transferred from the first cleaning member to the charging member via the second cleaning member, to transfer thereby toner from the first cleaning member to the charging member. Toner transferred to the charging member is transferred to a non-image area on the latent image carrier, such that the toner transferred to the non-image area is recovered by the developing device.

BRIEF DESCRIPTION OF THE DRAWINGS

The above and other objects, features and advantages of the present invention will become more apparent from the following detailed description taken with the accompanying drawings in which:

FIG. 15 is a table illustrating the relationship between linear speed ratio and toner dumping rate; and FIG. 16 is a table illustrating the results of experiments carried out under various conditions in the present invention.

DESCRIPTION OF THE PREFERRED EMBODIMENTS

Figure 1:
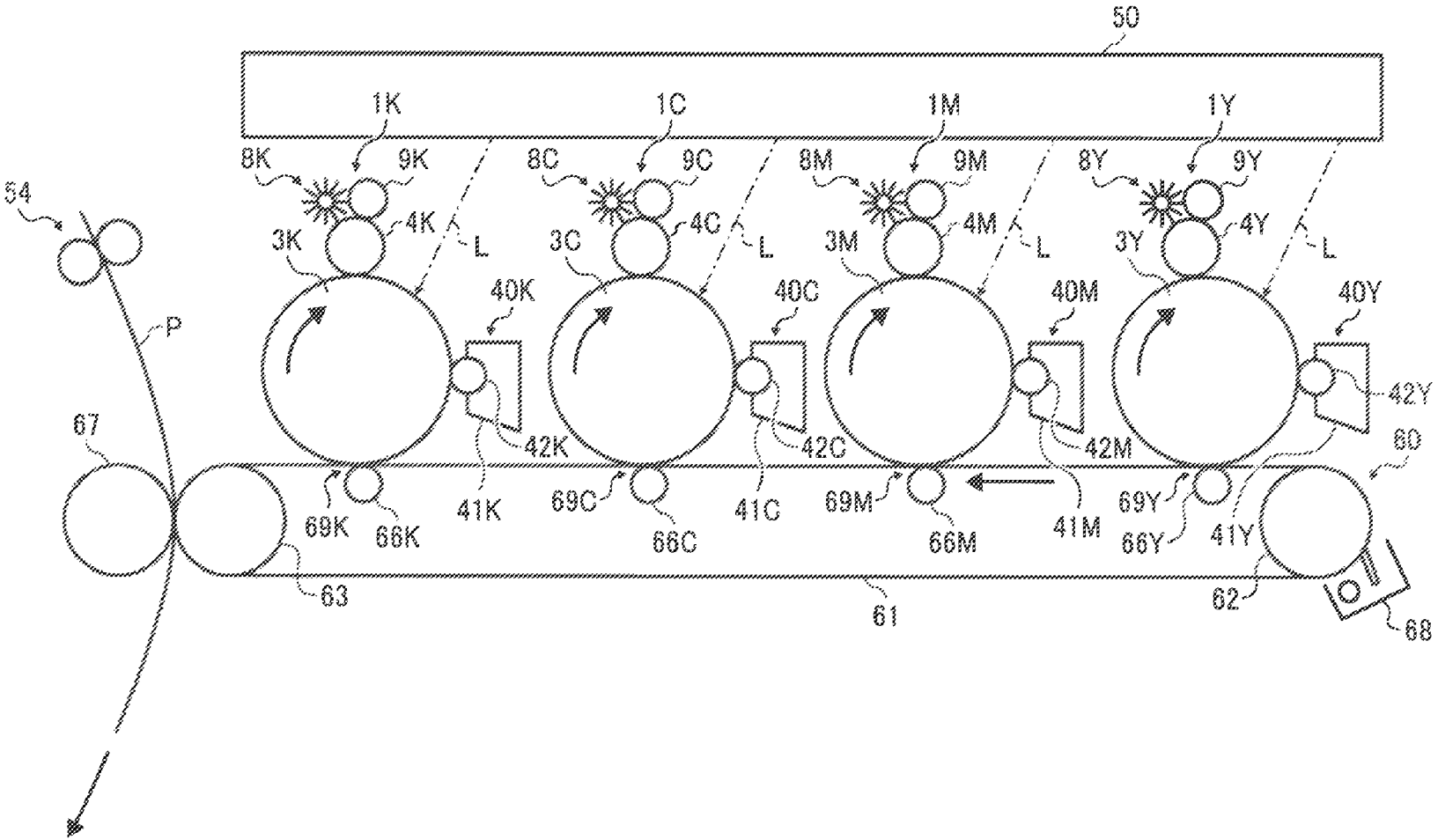
FIG. 1 is a diagram illustrating schematically the configuration of a printer according to an embodiment of the present invention.

In the present invention, firstly, toner recovered from a charging member by a first cleaning member is transferred from the first cleaning member to a second cleaning member, and hence no excess toner accumulates in the first cleaning member. This prevents toner from accumulating in the first cleaning member to the extent that the cleaning performance of the first cleaning member is impaired. Loss of cleaning performance by the first cleaning member can be curbed thereby, which allows the first cleaning member to clean well, over time, the charging member. In turn, this enables the charging member to charge well, over time, a latent image carrier.

Herein, a first bias supply means supplies bias to the charging member, and a third bias supply means supplies bias to the second cleaning member, in such a way that toner recovered in the second cleaning member is transferred by electrostatic forces to the charging member, to transfer thereby toner from the second cleaning member to the charging member; also, the first bias supply means supplies bias to the charging member and a second bias supply means supplies bias to the first cleaning member in such a way that toner recovered in the first cleaning member is transferred, through electrostatic forces, from the first cleaning member directly to the charging member, to transfer thereby toner from the first cleaning member to the charging member; and/or the first bias supply means supplies bias to the charging member, the second bias supply means supplies bias to the first cleaning member and the third bias supply means supplies bias to the second cleaning member in such a way that the toner is transferred from the first cleaning member to the charging member via the second cleaning member, to transfer thereby toner from the first cleaning member to the charging member. Further, toner transferred to the charging member is transferred to a non-image area on the latent image carrier, such that the toner transferred to the non-image area is recovered into a developing means. As a result, the toner recovered in the first cleaning member is transferred by electrostatic forces from the first cleaning member to the charging member, and hence the first cleaning member is cleaned and has the cleaning performance thereof restored. The toner transferred from the first cleaning member and the second cleaning member, via the charging member, to the non-image area on the latent image carrier, is recovered at the developing means, thus doing away with the need for providing, in the apparatus main body, a dedicated toner recovery unit for recovering toner. This allows reducing in proportion the size of the apparatus main body.

The "non image area" above refers to an area on the latent image carrier surface in which no image is formed, encompassing one revolution of the surface of the latent image carrier to which toner is dumped, from the location at which toner is dumped onto the surface of the latent image carrier.

Here follows a detailed explanation on one embodiment of an electrophotographic color laser printer (hereinafter, printer for short) as an image forming apparatus using the present invention.

The basic configuration of the printer according to the present embodiment will be explained first.

FIG. 1 illustrates the schematic configuration of a relevant portion of a printer according to the present embodiment. The printer comprises four process units 1Y, M, C, K for forming toner images of the colors yellow, magenta, cyan and black (hereinafter, Y, M, C, K). The printer comprises also an optical writing unit 50, a pair of resist rollers 54, a transfer unit 60 and the like. The letters Y, M, C, K suffixed to the various reference numerals denote members used for yellow, magenta, cyan and black, respectively.

The optical writing unit 50 has, for instance, a light source comprising four laser diodes corresponding to the respective colors Y, M, C, K, a regular-hexahedron polygon mirror, a polygon mirror motor for rotating the polygon mirror, an fθ lens, a lens, a reflection mirror and the like. Laser light L emitted by the laser diodes is reflected on any one of the faces of the polygon mirror, being deflected as the polygon mirror rotates, and reaches any of four photosensitive elements described below. The surfaces of the four photosensitive elements are scanned by the laser light L emitted by the respective four laser diodes.

The process units 1Y, 1M, 1C, 1K have, for instance, drum-like photosensitive elements 3Y, 3M, 3C, 3K as latent image carriers, and developing devices 40Y, 40M, 40C, 40K corresponding individually to the photosensitive elements 3Y, 3M, 3C, 3K. The photosensitive elements 3Y, 3M, 3C, 3K, which comprise a tube of aluminum or the like covered with an organic photosensitive layer, are rotated in the clockwise direction in the figure, with a predefined linear speed, by driving means not shown. The photosensitive elements 3Y, 3M, 3C, 3K carry Y, M, C, K electrostatic latent images that are scanned in the dark by the optical writing unit 50 that emits laser light L modulated on the basis of image information transmitted by a personal computer or the like, not shown.

Figure 2:
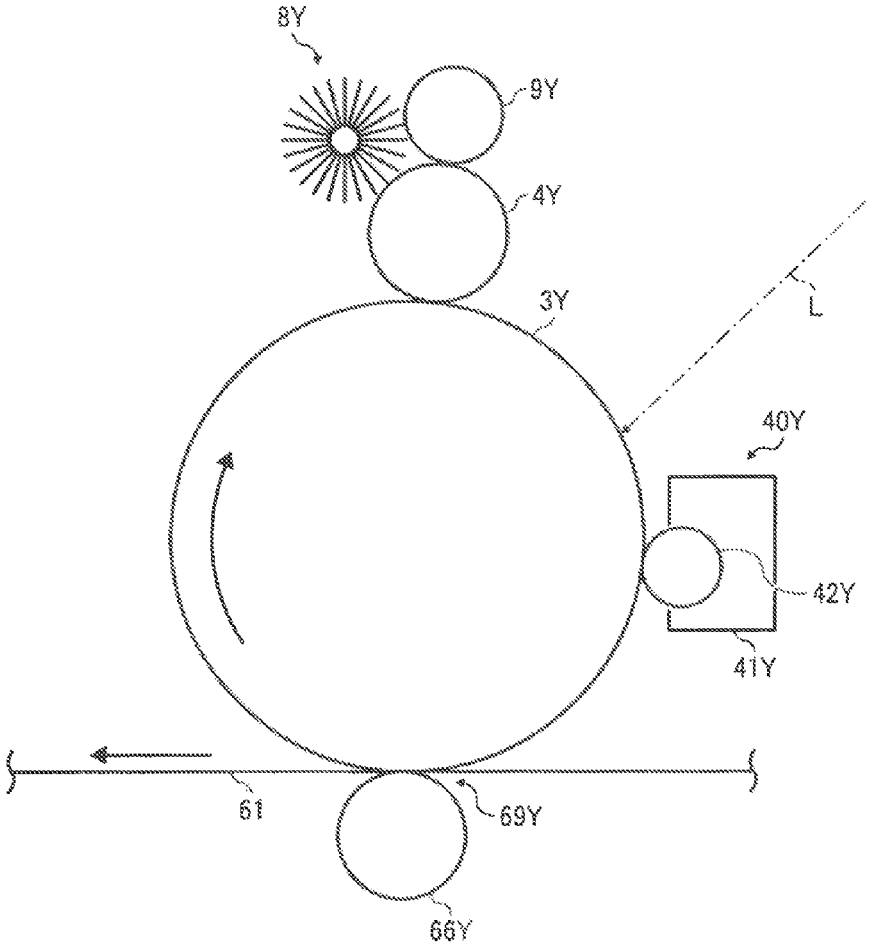
FIG. 2 is a diagram illustrating schematically the configuration of a process unit for Y.

FIG. 2 illustrates a process unit 1Y for Y among the process units 1Y, 1M, 1C, 1K, as well as an intermediate transfer belt 61 of the transfer unit 60 of FIG. 1. The process unit 1Y for Y in the figure holds therein, as a single unit, a photosensitive element 3Y, a charging roller 4Y, a cleaning brush 8Y, a discharging lamp not shown, and a developing device 40Y as a developing means, among others, in a common casing (receptacle), such that the process unit 1Y for Y is detachable from the printer main body.

The photosensitive element 3Y for Y, which is a latent image carrier to be charged, is a drum having a diameter of about 24 mm comprising an aluminum tube the surface of which is covered by a photosensitive layer comprising a negatively-charged organic photoconductor (OPC). The photosensitive element 3Y is rotated in the clockwise direction of the figure, with a predefined linear speed, by a driving means not shown.

The surface of the charging roller 4Y, which has a metal shaft rotatably journaled in a bearing not shown, rubs against the photosensitive element 3Y as the charging roller 4Y is rotated around the center of the shaft in the clockwise direction of the figure by a driving means not shown. To the shaft there is connected a power supply device 70, which is a charging bias supply means comprising, for instance, a power supply, wiring and the like, provided with the device main body. The power supply device 70 applies charging bias comprising DC voltage. In the present printer there is thus configured a charging system for charging uniformly the peripheral surface of the photosensitive element 3Y, comprising, for instance, the charging roller 4Y, driving means, not shown, for driving the charging roller 4Y, as well as the above-described charging bias supply device. The surface of the photosensitive element 3Y is uniformly charged, for instance negatively, through electric discharge between the charging roller 4Y and the photosensitive element 3Y. In the charging system, the charging roller 4Y, is arranged together with the photosensitive element 3Y and the like in the process unit 1Y, as a single unit, the charging roller 4Y being attached to and removed from the printer main body. This enables replacement with a new one when, for instance, the charging roller 4Y becomes dirty with toner or when the photosensitive element 3Y fails to become charged well regularly.

On the surface of the uniformly charged photosensitive element 3Y for Y there is formed an electrostatic latent image for Y through scanning by the optical writing unit 50. This electrostatic latent image is developed into a Y toner image by the developing device 40Y for Y.

The developing device 40Y for Y has a developing roller 42Y arranged facing the photosensitive element 3Y, such that a portion of the peripheral surface of the developing roller 42Y protrudes out of an opening provided in a casing 41Y, to come into contact with the photosensitive element 3Y. This developing roller is rotated by a rotating means not shown. In the casing 41Y there is stored Y developer, not shown, having negative Y toner as a main component thereof. In the present embodiment there is used, as the developer, pulverized toner having a particle size of 8.5 μm, with an external additive treatment that involves adding 1% of HMDS-treated silica having a specific surface area of 200 $m^2/g$ and 2% of HMDS-treated silica having a specific surface area of 90 $m^2/g$. The Y developer is soaked up by the surface of the developing roller. Then, accompanying the rotation of the developing roller, the layer thickness of the developer is adjusted upon passing at a position opposite a developer tank 43Y, not shown, whereafter the developer is transported coming into contact with a developing region facing the photosensitive element 3Y, where the developer develops the electrostatic latent image on the photosensitive element 3Y into a toner image.

The Y toner image on the photosensitive element 3Y is intermediate-transferred to the intermediate transfer belt 61 by way of a primary transfer nip for Y abutting the photosensitive element 3Y and the intermediate transfer belt 61. Transfer residual toner transferred to the intermediate transfer belt 61 becomes adhered to the surface of the photosensitive element 3Y having passed through the primary transfer nip. This transfer residual toner adheres to the surface of the charging roller 4Y abutting the photosensitive element 3Y. The cleaning brush 8Y, however, removes the transfer residual toner adhered to the surface of the charging roller 4Y. The power supply device 71 provided in the apparatus main body applies bias to the cleaning brush 8Y. The cleaning brush 8Y is removably mounted on the printer main body. This allows replacing the cleaning brush 8Y by a new one in case of loss of cleaning performance. The precision with which the cleaning brush 8Y is mounted relative to the charging roller 4Y need not be as high as the precision with which the charging roller 4Y is mounted relative to the photosensitive element 3Y, and hence it is better to keep the charging roller 4Y clean by replacing the cleaning brush 8Y by a new one, when the cleaning performance thereof is impaired, than to replace the charging roller 4Y by a new one depending on how contaminated the charging roller 4Y is.

The plural flocked fibers of the cleaning brush 8Y are conductive fibers cut to a predefined length. As the material of the conductive fibers there may be used, for instance, resin materials such as nylon 6™, nylon 12™, acrylic fibers, Teflon™ and the like. Such resin fibers are imparted conductivity through dispersion therein of conductive particles such as carbon, metal microparticles or the like. In terms of manufacturing costs and low Young modulus, a nylon resin with carbon dispersed therein is preferred. Carbon may be dispersed unevenly in the fibers.

The configuration of the process unit 1Y for Y explained thus far is identical to that of the process units 1M, 1C, 1K, and hence an explanation of the latter will be omitted.

In FIG. 1, the transfer unit 60 is arranged below the process units 1Y, 1M, 1C, 1K of respective colors. In the belt unit 60 the endless-type intermediate transfer belt 61 is moved endlessly in the counterclockwise direction of the figure while stretched by plural tension rollers. Specifically, the plural tension rollers may include, for instance, a driven roller 62, a driving roller 63, and four primary transfer bias rollers 66Y, 66M, 66C, 66K.

The driven roller 62, the driving roller 63, and the four primary transfer bias rollers 66Y, 66M, 66C, 66K are all in contact with the rear face (loop inner peripheral face) of the intermediate transfer belt 61. The primary transfer bias rollers 66Y, 66M, 66C, 66K, which are rollers that comprise a metal interior covered with an elastic body such as a sponge or the like, sandwich the intermediate transfer belt 61 pressing it against the photosensitive elements 3Y, 3M, 3C, 3K for Y, M, C, K. As a result there form four primary transfer nips for Y, M, C, K, as primary transfer portions 69, in which the photosensitive elements 3Y, 3M, 3C, 3K and the intermediate transfer belt 61 come into contact over a predefined length along the movement direction of the belt.

A constant primary transfer bias, controlled to constant current, is applied by respective transfer bias power sources, not shown, to the interior of the four primary transfer bias rollers 66Y, 66M, 66C, 66K. As a result, transfer charge is imparted to the rear face of the intermediate transfer belt 61 via the four primary transfer bias rollers 66Y, 66M, 66C, 66K, and a transfer electric field forms between the intermediate transfer belt 61 and the photosensitive elements 3Y, 3M, 3C, 3K at the respective primary transfer nips. In the present printer the primary transfer bias rollers 66Y, 66M, 66C, 66K are provided as primary transfer means, but instead of rollers there may also be used brushes, blades or the like. A transfer charger or the like may also be used.

The Y, M, C, K toner images formed on the photosensitive elements 3Y, 3M, 3C, 3K are transferred superposedly onto the intermediate transfer belt 61, at the primary transfer nips of the respective colors. As a result there forms a four-color superposed toner image (hereinafter, four-color toner image) on the intermediate transfer belt 61.

A secondary transfer nip is formed where a secondary transfer bias roller 67 abuts the intermediate transfer belt 61, on the front side of the belt, at the position where the intermediate transfer belt 61 is rotated by the driving roller 63. A voltage applying means, not shown, comprising a power supply and wiring, applies secondary transfer bias to the secondary transfer bias roller 67. As a result there forms a secondary transfer electric field between the secondary transfer bias roller 67 and a grounded secondary transfer nip rear roller 64. The four-color toner image formed on the intermediate transfer belt 61 enters into the secondary transfer nip as a result of the endless motion of the belt.

The present printer comprises a paper feed cassette, not shown, in which there are stacked reams of plural sheets of recording paper P. In accordance with a predefined timing, the uppermost sheet of recording paper P is fed over a paper feeding path. The fed recording paper P is gripped in a resist nip of the pair of resist rollers 54 arranged at the end of the paper feeding path.

In the pair of resist rollers 54 both rollers rotate to grip the recording paper P fed from the paper feed cassette to be gripped in the resist nip. Both rollers, however, stop rotating as soon as the tip of the recording paper P is gripped. The recording paper P is fed toward the secondary transfer nip with a timing that can be synchronized to the four-color toner image on the intermediate transfer belt 61. Through the effect of the secondary transfer electric field and/or nip pressure, the four-color toner image on the intermediate transfer belt 61 is transferred as one onto the recording paper P, becoming a full color image with white color, at the secondary transfer nip.

The recording paper P, with a full color image formed thus thereon, is driven off the secondary transfer nip, and is then fed to a fixing device, not shown, where the full color image is fixed.

Secondary transfer residual toner adhering to the surface of the intermediate transfer belt 61 after passing through the secondary transfer nip is removed from the belt surface by a belt cleaning device 68.

In the present printer having the above basic configuration, the four photosensitive elements 3Y, 3M, 3C, 3K function as latent image carriers that carry respective latent images on their surfaces moving endlessly through rotation. The optical writing unit 50 functions as a latent image forming means for forming a latent image on the photosensitive elements after uniform charging thereof. Also, a drive source and a drive transmission system comprising, for instance, a motor and a gear train for rotationally driving the photosensitive elements 3Y, 3M, 3C, 3K, thus moving endlessly the surfaces of the latter, as well as a drive control unit, not shown, for controlling the switching on/off of the drive source, function herein as a latent image carrier driving means. The drive control unit is made up of a control circuit comprising a well-known CPU or the like, and an information storage means such as a RAM or the like.

The characterizing parts of the printer according to the present embodiment are explained next based on examples. Unless specified otherwise, the basic configuration of the printer according to the various examples is identical to the above-described one.

EXAMPLE 1

As illustrated in FIG. 1, the printer according to the present example uses a so-called cleanerless method. In a cleanerless method, no dedicated means is used for cleaning and recovering the transfer residual toner adhered to a latent image carrier such as the photosensitive element 3Y. Instead, the image forming process is carried out on the latent image carrier. Specifically, a dedicated means for cleaning and recovery is a means for separating transfer residual toner from the latent image carrier, and recovering the transfer residual toner by transporting it to a waste toner container, preventing the transfer residual toner from adhering again to the latent image carrier, and/or for recycling and recovering the transfer residual toner by transporting it into the developing device 40Y. The dedicated means includes also a cleaning blade for scraping transfer residual toner from the latent image carrier.

The cleanerless method is explained in detail next.

Broadly, cleanerless methods can be classified into scatter passage, temporary capture, and combined types. In scatter passage types there is used a scattering member, such as a brush or the like, that exerts sliding friction on the latent image carrier, scraping thereby transfer residual toner off the latent image carrier, and weakening as a result adherence between transfer residual toner and the latent image carrier. Thereafter, the transfer residual toner is recovered at the developing device 40Y through electrostatic transfer of the toner on the latent image carrier to a developing member such as a developing sleeve, developing roller or the like, at a developing area in which a developing member such as the developing roller or the like faces the latent image carrier, or immediately before such a developing area. Prior to such a recovery, the transfer residual toner passes by the optical writing position for latent image writing, but this does not affect negatively latent image writing, provided that the amount of transfer residual toner is relatively small. However, when the transfer residual toner comprises reversely-charged toner, being charged with an inverse polarity to a regular polarity, the reversely-charged toner cannot be recovered on the developing member and gives rise to scumming or the like. With a view to suppressing the occurrence of scumming due to such reversely-charged toner, it is preferable to provide a toner charging means, for imparting regular-polarity charge to transfer residual toner on a latent image carrier, between a transfer position (for instance, a primary transfer nip) and a scattering position by the scattering member, or between a scattering position and the developing area. As the scattering member there may be used, for instance, a fixed brush having plural flocked fibers comprising conductive fibers attached to a plate, unit casing or the like; a brush roller in which plural flocked fibers are set standing on a metallic rotating shaft member; or a roller member having a roller portion comprising a conductive sponge or the like.

In a temporary-capture cleanerless method, the transfer residual toner on the latent image carrier is temporarily captured by means of a rotating member such as a charging roller or a brush roller moving endlessly with the surface thereof touching against the latent image carrier. When, for instance, a print job is over, or at timings between papers during a print job, transfer residual toner on a rotating member is dumped and re-transferred to the latent image carrier, whereafter the transfer residual toner is recovered at the developing device 40Y by being electrostatically transferred to a developing member such as a developing roller or the like. In the above-described scatter passage type, when there is a substantial amount of transfer residual toner, for instance during formation of a solid image, or in case of a jam, the capacity for recovering toner at the developing member is overwhelmed, which may result in image deterioration. In temporary capture, by contrast, such image deterioration can be curbed through gradual recovery, into the developing member, of transfer residual toner captured by the rotating member.

In a combined-type cleanerless method there are used concomitantly both scatter passage and temporary capture. Specifically, there are used concomitantly a rotating brush member or the like in contact with the latent image carrier, together with a scattering member and a capture member. Herein, a rotating brush member or the like functions as a scattering member through application of a DC voltage to the rotating brush member or the like, while the rotating brush member or the like can be made to function as a capture member by switching bias, as the case may require, from DC voltage to AC/DC/AC voltage.

In the present example, a temporary capture method is used in the process unit 1Y. In the present example, the configuration explained for the present embodiment comprises also a cleaning auxiliary roller 9Y in contact with the charging roller 4Y and the cleaning brush 8Y, as well as a power supply device 72 that applies bias to the cleaning auxiliary roller 9Y. Preferably, the cleaning auxiliary roller 9Y is a metal roller.

A transfer residual toner recovery mode is executed herein in order to prevent defective charging of the photosensitive element 3Y during a print job, i.e. during printing or image forming when the optical writing unit 50 writes a latent image. More specifically, the photosensitive element 3Y, being rotated in the clockwise direction of the figure with a predefined linear speed, forms a primary transfer nip for Y by coming into contact with the front face of the intermediate transfer belt 61. The transfer residual toner adhered to the photosensitive element 3Y having passed through the primary transfer nip is transferred to the charging roller 4Y through the frictional forces generated between the photosensitive element 3Y and the charging roller 4Y. The transfer residual toner thus transferred to the charging roller 4Y is then temporarily captured by being further transferred to the cleaning brush 8Y as a result of the frictional forces generated between the charging roller 4Y and the cleaning brush 8Y. When, for instance, the toner accumulation level in the cleaning brush 8Y exceeds a limit, the transfer residual toner captured in the cleaning brush 8Y is transferred, through electrostatic forces, to the cleaning auxiliary roller 9Y. The transfer residual toner transferred to the cleaning auxiliary roller 9Y is further transferred, through electrostatic forces, to the charging roller 4Y.

The arrow in FIG. 1 indicates herein an optimal travel direction of toner between the various members. That is, the transfer residual toner, which is recovered from the photosensitive element 3Y by the charging roller 4Y, and is transferred to the cleaning brush 8Y, is made to circulate between the cleaning brush 8Y, the cleaning auxiliary roller 9Y and the charging roller 4Y. If transfer residual toner accumulates only in the cleaning brush 8Y, the transfer residual toner ends up then creeping gradually from around the end of the cleaning brush 8Y towards the interior of the brush when an excessive transfer residual toner accumulates in the cleaning brush 8Y. The electrostatic forces generated between the various members, and which move the transfer residual toner around, become weaker as the contact portions between the various members are further away from one another. As a result, during transfer by electrostatic forces of accumulated transfer residual toner from the below-described cleaning brush 8Y to the charging roller 4Y and the cleaning auxiliary roller 9Y, the transfer residual toner accumulated at the interior of the brush becomes difficult to move from the cleaning brush 8Y towards the charging roller 4Y or the cleaning auxiliary roller 9Y, remaining thus in the cleaning brush 8Y. Transfer residual toner remaining thus in the cleaning brush 8Y ends up impairing, in a short time, the cleaning performance of the cleaning brush 8Y. Therefore, causing transfer residual toner to circulate between various members, as in the present example, allows preventing excessive accumulation of transfer residual toner in the cleaning brush 8Y while suppressing creep of transfer residual toner towards the brush interior, allowing thus the cleaning brush 8Y to retain its good cleaning performance over time. The amount of toner moving between members is largest between the charging roller 4Y and the cleaning brush 8Y, large between the cleaning brush 8Y and the cleaning auxiliary roller 9Y, and smallest between the cleaning auxiliary roller 9Y and the charging roller 4Y.

Figure 3:
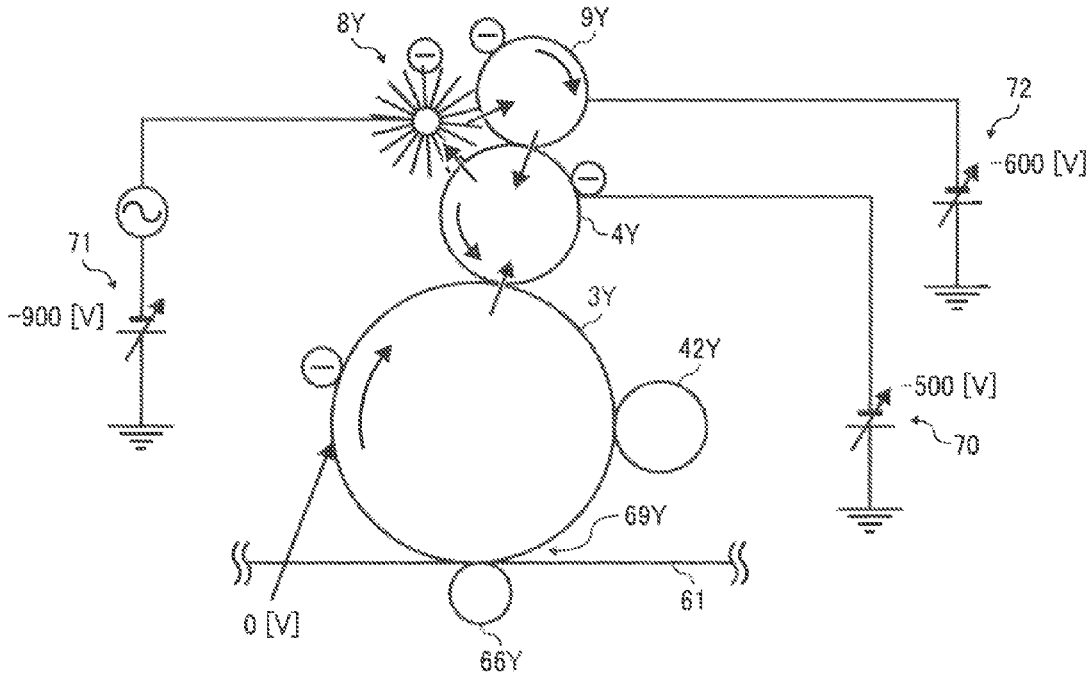
FIG. 3 is a diagram illustrating schematically the configuration of a process unit during a print job in Example 1 of the present invention.

In the present example, as illustrated in FIG. 3, there is applied a bias of −500 V to the charging roller 4Y, of −400 V to the cleaning brush 8Y, and of −400V to the cleaning auxiliary roller 9Y, during a print job. That is, the bias applied to respective members during a print job is such that the potential of the charging roller 4Y, the potential of the cleaning brush 8Y and the potential of the cleaning auxiliary roller 9Y satisfy the relationship: potential of the cleaning brush 8Y<potential of the cleaning auxiliary roller 9Y<potential of the charging roller 4Y. Applying bias to the various members based on such a relationship enables transfer of transfer residual toner from the cleaning brush 8Y to the cleaning auxiliary roller 9Y, and transfer of transfer residual toner from the cleaning auxiliary roller 9Y to the charging roller 4Y, by way of electrostatic forces.

Figure 4:
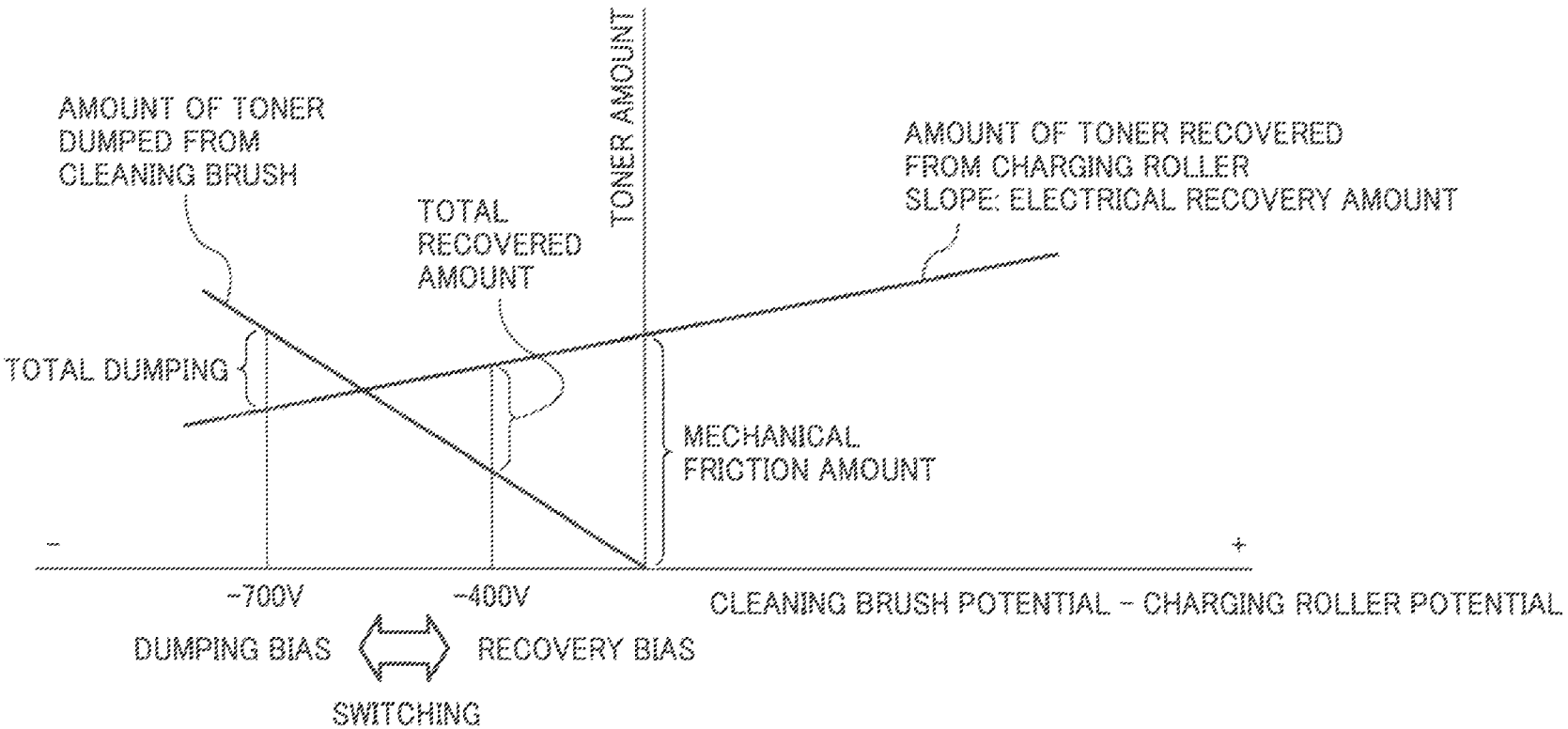
FIG. 4 is a diagram for explaining potential setting relating to transfer of toner between a charging roller and a cleaning brush.

Transfer of transfer residual toner from the photosensitive element 3Y to the charging roller 4Y, and transfer of transfer residual toner from the charging roller 4Y to the cleaning brush 8Y are effected by the above frictional forces that exceed the electrostatic forces. Herein, as described above, there is satisfied the relationship to the effect that potential of the cleaning brush 8Y<potential of the charging roller 4Y, while the potential of the photosensitive element 3Y having passed through the primary transfer nip drops to a potential, of 0 V in the present example, that is lower than that before passing through the primary transfer nip. As a result, transfer residual toner is transferred by electrostatic forces from the cleaning brush 8Y to the charging roller 4Y, and from the charging roller 4Y to the photosensitive element 3Y. In the present example, therefore, transferring of transfer residual toner from the photosensitive element 3Y to the charging roller 4Y, and transferring of transfer residual toner from the charging roller 4Y to the cleaning brush 8Y are effected by frictional forces that exceed the electrostatic forces generated between the photosensitive element 3Y and the charging roller 4Y, and between the charging roller 4Y and the cleaning brush 8Y. For instance, the amount of toner recovered from the charging roller 4Y to the cleaning brush 8Y during a print job is an amount given by subtracting the amount of toner transferred from the cleaning brush 8Y to the charging roller 4Y by electrostatic forces, from the amount of toner transferred from the charging roller 4Y to the cleaning brush 8Y by frictional forces, as illustrated in FIG. 4. Thus, frictional forces exceeding electrostatic forces allow transferring the transfer residual toner from the charging roller 4Y to the cleaning brush 8Y, i.e., recovering to the cleaning brush 8Y the transfer residual toner adhered to the charging roller 4Y.

The rotation direction of the cleaning brush 8Y is herein the same as the rotation direction of the charging roller 4Y, i.e. the cleaning brush 8Y rotates in a direction counter to the rotation of the charging roller 4Y. Such a rotation of the cleaning brush 8Y in a counter direction elicits large frictional forces that allow scraping transfer residual toner from the charging roller 4Y into the cleaning brush 8Y. The linear speed of the cleaning brush 8Y (rotational speed) is preferably faster than the linear speed of the cleaning auxiliary roller 9Y and than the linear speed of the charging roller 4Y. For instance, the linear speed of the cleaning brush 8Y is set to 250 mm/s versus a linear speed of 100 mm/s for the cleaning auxiliary roller 9Y and the charging roller 4Y, with a ratio of 2.5 of the linear speed of the cleaning brush 8Y vis-à-vis the linear speed of the cleaning auxiliary roller 9Y and the linear speed of the charging roller 4Y.

A transfer residual toner dumping mode is executed during non-print job times, i.e. when the optical writing unit 50 is not writing a latent image, for instance after termination of a print job, at timings between papers or upon non-printing. During non-print job times, specifically, the transfer residual toner captured in the cleaning brush 8Y is transferred, directly and via the cleaning auxiliary roller 9Y, to the charging roller 4Y, by switching the bias applied to the charging roller 4Y, the cleaning brush 8Y and the cleaning auxiliary roller 9Y. The transfer residual toner transferred to the charging roller 4Y is re-transferred to a non-image area of the photosensitive element 3Y, through electrostatic and frictional forces. Unless specified otherwise, hereafter the toner is transferred from the charging roller 4Y to a non-image area on the photosensitive element 3Y. The toner is recovered then from the photosensitive element 3Y to the developing device 40Y via the developing roller 42Y.

Figure 5:
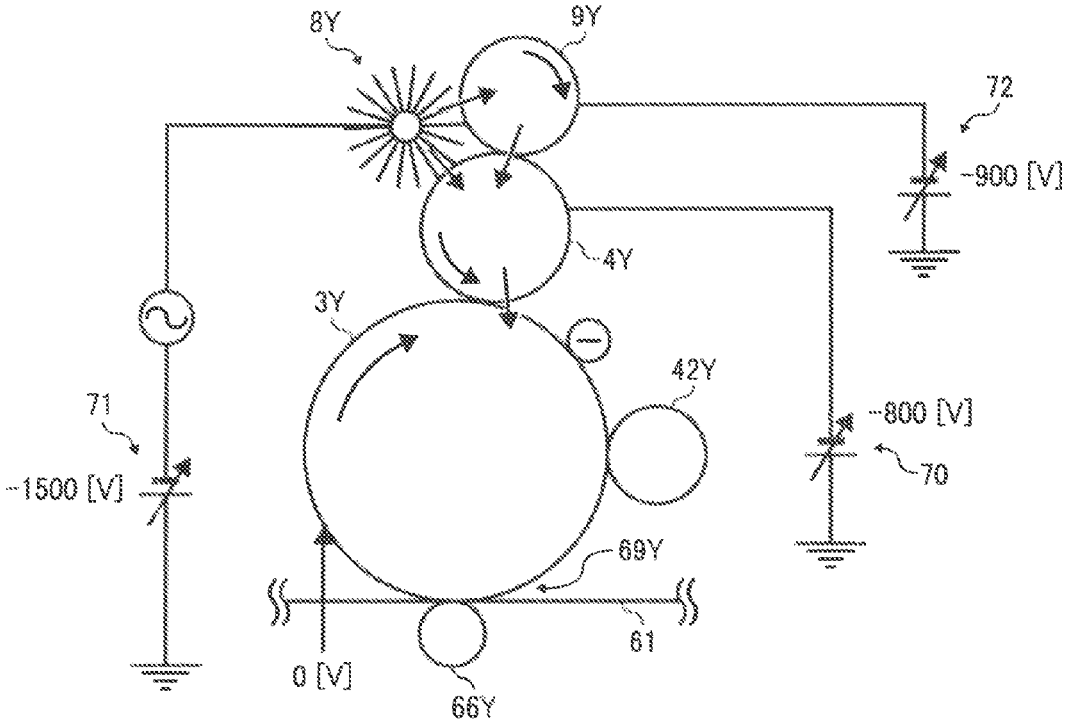
FIG. 5 is a diagram illustrating an optimal toner motion direction during non print job times.

The arrow in FIG. 5 indicates herein an optimal travel direction of toner between the various members. In the present example there is applied a bias of −800 V to the charging roller 4Y, of −1500 V to the cleaning brush 8Y, and of −600V to the cleaning auxiliary roller 9Y, during non-print job times. That is, the bias applied to respective members at that time is such that the potential of the charging roller 4Y, of the cleaning auxiliary roller 9Y, of the cleaning brush 8Y, and of the photosensitive element 3Y having passed through the primary transfer nip, satisfy the relationship: potential of the cleaning brush 8Y<potential of the cleaning auxiliary roller 9Y<potential of the charging roller 4Y<potential of the photosensitive element 3Y having passed through the primary transfer nip.

The potential difference between the cleaning brush 8Y and the charging roller 4Y must be set in such a way that the amount of toner transferred by electrostatic forces from the cleaning brush 8Y to the charging roller 4Y is larger than the amount of toner transferred by frictional forces from the charging roller 4Y to the cleaning brush 8Y, as illustrated in FIG. 4. Similarly, the potential difference between the photosensitive element 3Y and the charging roller 4Y must be set in such a way that the amount of toner transferred by electrostatic forces from the charging roller 4Y to the photosensitive element 3Y is larger than the amount of toner transferred by frictional forces from the photosensitive element 3Y to the charging roller 4Y. Satisfying such potential relationships between the various members allows transferring, by electrostatic forces, the transfer residual toner adhered to the various members, with good efficiency, in the directions denoted by the arrows in FIG. 5.

Preferably, the ratio of the linear speed of the cleaning brush 8Y relative to the linear speed of the charging roller 4Y and the linear speed of the cleaning auxiliary roller 9Y is set to range from 0.1 to 0.9, and/or the linear speed of the cleaning brush 8Y is set to be larger than the linear speed of the charging roller 4Y and the linear speed of the cleaning auxiliary roller 9Y. Doing so allows the transfer residual toner captured in the cleaning brush 8Y to be dumped, with good efficiency, to the charging roller 4Y and the cleaning auxiliary roller 9Y.

Figure 6:
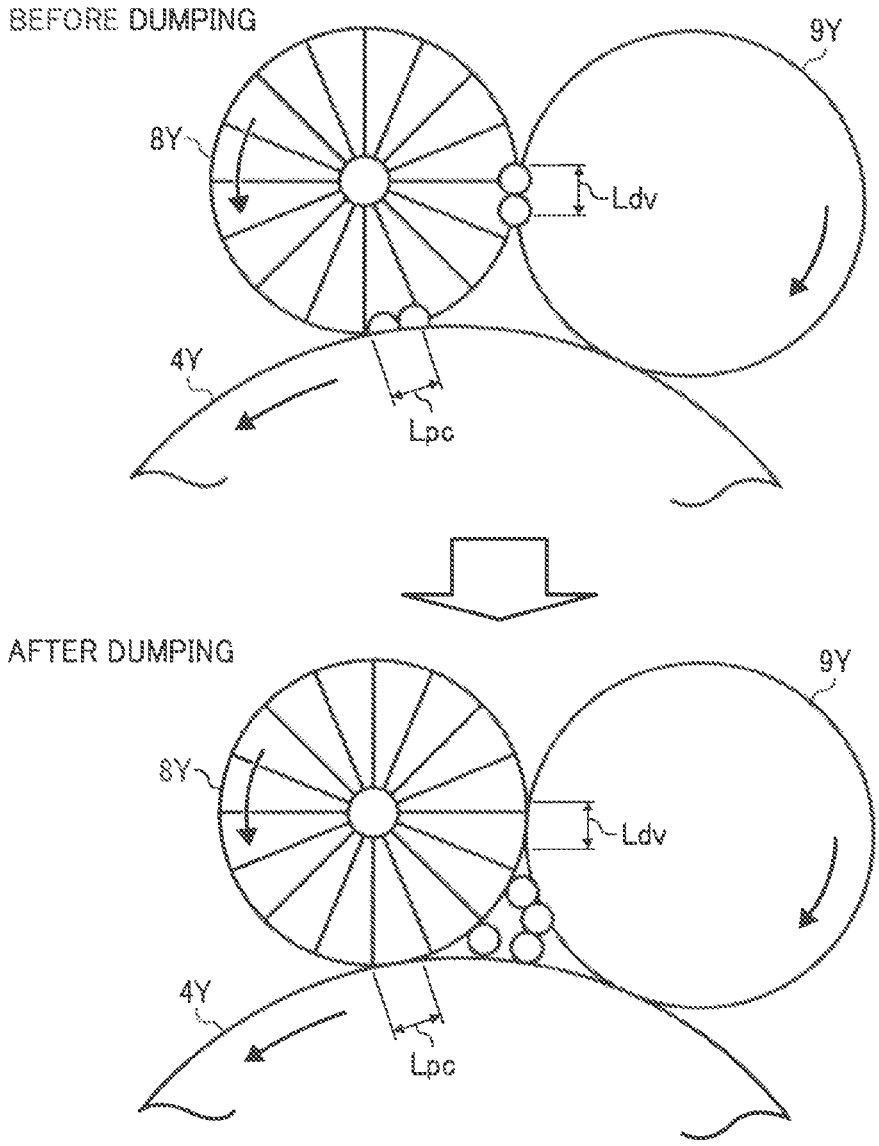
FIG. 6 is a diagram for explaining toner dumping when a linear speed ratio is smaller than 0.1.
Figure 7:
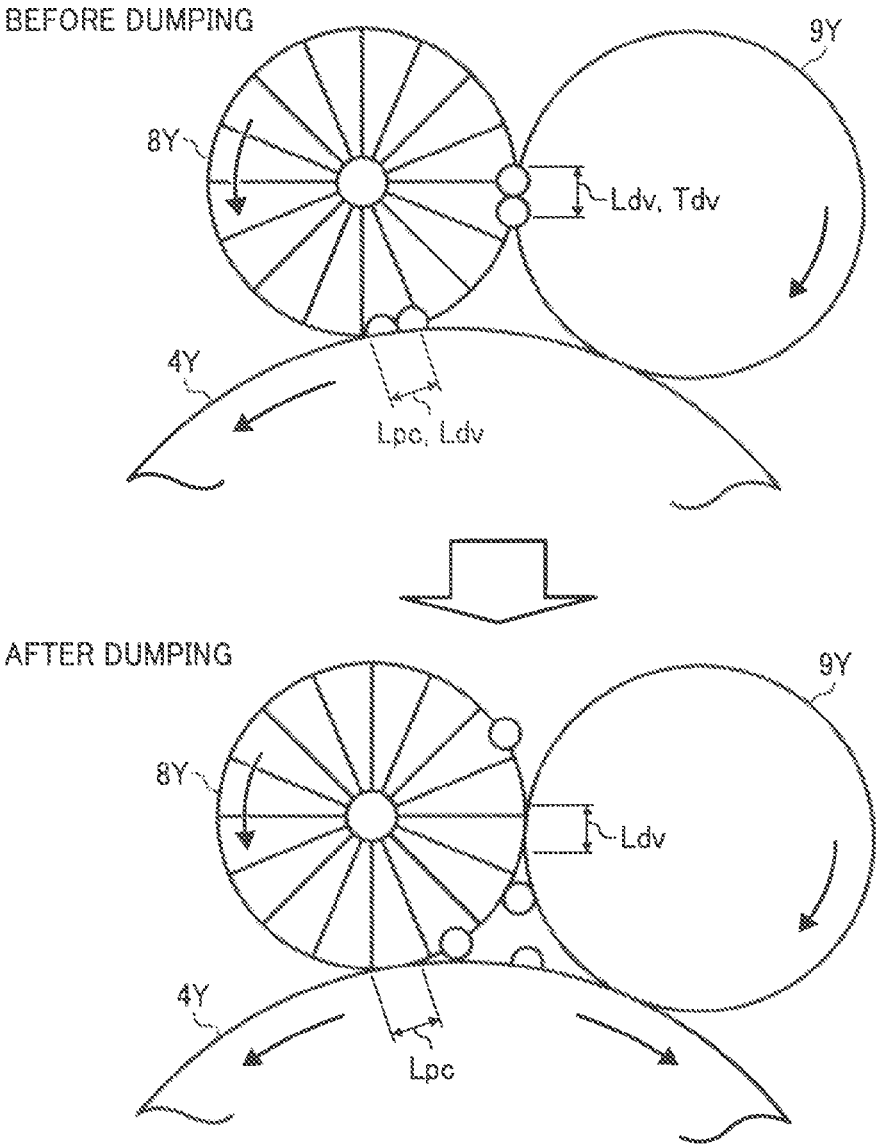
FIG. 7 a diagram for explaining toner dumping when the linear speed ratio is greater than 0.9.

During dumping, the toner captured in the cleaning brush 8Y is dumped to the charging roller 4Y and the cleaning auxiliary roller 9Y at the portions where voltage can be applied, illustrated in FIGS. 6 and 7 (Lpc, Ldv). That is, as the cleaning brush 8Y rotates, the outer periphery of the cleaning brush 8Y moves sequentially onto the portions where voltage can be applied (Lpc, Ldv), whereby the toner transported to the outer periphery of the cleaning brush 8Y becomes dumped to the charging roller 4Y and the cleaning auxiliary roller 9Y. When the above linear speed ratio is smaller than 0.1, however, the cleaning brush 8Y rotates slowly, so that the portions where voltage can be applied (Lpc, Ldv) appear to stay at virtually the same location. When the above linear speed ratio is smaller than 0.1, therefore, the overall toner dumping efficiency becomes impaired. The toner dumping time (Tpc, Tdv) at a predefined portions of the cleaning brush 8Y, the portions where voltage can be applied (Lpc, Ldv), and the displacement speed (linear speed) of the cleaning brush 8Y are interrelated in accordance with Eq. (1). When the linear speed ratio is greater than 0.9, the motion speed (V) becomes faster, and hence the toner dumping time (Tpc, Tdv), as given by Eq. (1), becomes shorter. When the linear speed ratio is greater than 0.9, therefore, the dumping time of the toner from the cleaning brush 8Y to the charging roller 4Y and the cleaning auxiliary roller 9Y, at the portions where voltage can be applied, becomes shorter, which impairs toner dumping efficiency.

$$Tpc=Lpc/V \text{ and } Tdv=Ldv/V \qquad \text{Eq. (1)}$$

With a view to maintaining the long-term cleaning performance of the cleaning brush 8Y, the toner dumping rate from the cleaning brush 8Y is preferably not lower than 15%. The relationship between the linear speed ratio and the toner dumping rate is illustrated in FIG. 15. The linear speed of the charging roller 4Y and the linear speed of the cleaning auxiliary roller 9Y are both 100 mm/s.

FIG. 15 shows that a linear speed ranging from 0.1 to 0.9 results in a toner dumping rate not lower than 15%. This indicates that during non-print job times, as in the present example, setting the linear speed ratio to range from 0.1 to 0.9 allows toner to be dumped from the cleaning brush 8Y with good efficiency.

The cleaning brush 8Y becomes clean through dumping of the transfer residual toner captured in the cleaning brush 8Y to the photosensitive element 3Y, via the charging roller 4Y. This allows hence preserving the cleaning performance of the cleaning brush 8Y. Therefore, the cleaning brush 8Y also cleans well the charging roller 4Y, which enables in turn good charging of the photosensitive element 3Y by the charging roller 4Y. A cleaning roller may be used instead of the cleaning brush 8Y. In such a case, the surface of the cleaning roller is preferably elastic, and comprises for instance urethane foam. During recovery of transfer residual toner from the charging roller 4Y to a cleaning roller or the like through frictional forces in addition to electrostatic forces, the cleaning roller and the charging roller 4Y must come into contact to such an extent that the surface of the cleaning roller collapses through elastic deformation, with a view to achieving a large frictional forces. Such a contact condition can be achieved by using a cleaning roller having an elastic surface of urethane foam or the like, and hence large frictional forces can be obtained at the contact portion between the charging roller 4Y and the cleaning roller. Also, the surface of the urethane foam has irregularities that facilitate scraping of the transfer residual toner from the charging roller 4Y.

In the present example described above, transfer residual toner is recovered at the developing device 40Y, without providing a dedicated cleaning device for recovering the transfer residual toner. Employing a cleanerless system such as the one of the present example does away with the need for a dedicated recovery toner holding portion for recovering transfer residual toner, thereby reducing effectively the size of the apparatus main body. Also, the recovered toner can be used for again developing, thus making toner usage more efficient in economic terms.

Modification

Figure 8:
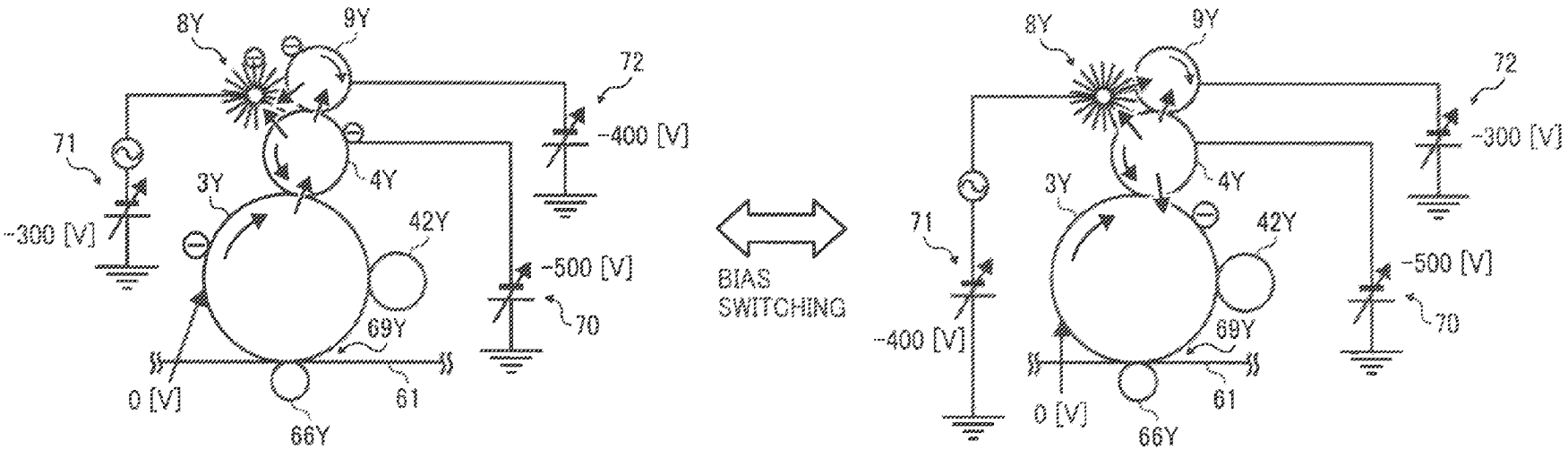
FIG. 8 is a diagram for explaining the toner motion direction during a print job in a modification of the present invention.

In the present modification, the toner adhered to the charging roller 4Y is transferred directly and via the cleaning auxiliary roller 9Y to the cleaning brush 8Y, as illustrated in FIG. 8. As a result, the surface of the charging roller 4Y can be kept cleaner than in Example 1. In the present modification, moreover, the toner of the cleaning brush 8Y is transferred to the cleaning auxiliary roller 9Y by switching the bias applied to the cleaning brush 8Y and the cleaning auxiliary roller 9Y, as illustrated in FIG. 8, when, for instance, the toner accumulation level in the cleaning brush 8Y exceeds a limit during a print job. Also, the toner in the cleaning auxiliary roller 9Y is re-transferred to the cleaning brush 8Y after averaging the variation of the toner contaminated positions at the cleaning auxiliary roller 9Y. This allows suppressing creeping of toner from around the brush end into the interior of the brush as a result an excessive accumulation of toner in the cleaning brush 8Y. Hence, toner can be transferred from the cleaning brush 8Y to the charging roller 4Y and the cleaning auxiliary roller 9Y by electrostatic forces, as in Example 1, without toner remaining in the cleaning brush 8Y, during non-print job times.

In the same way as in Example 1, during non-print job times the toner is transferred from the cleaning brush 8Y, directly or via the cleaning auxiliary roller 9Y, to the charging roller 4Y, through application of bias to the various members, as illustrated in FIG. 5. The toner transferred to the charging roller 4Y is further transferred to the photosensitive element 3Y, while the toner transferred to the photosensitive element 3Y is recovered at the developing device 40.

Experiments carried out by the three inventors are explained next.

Figure 9:
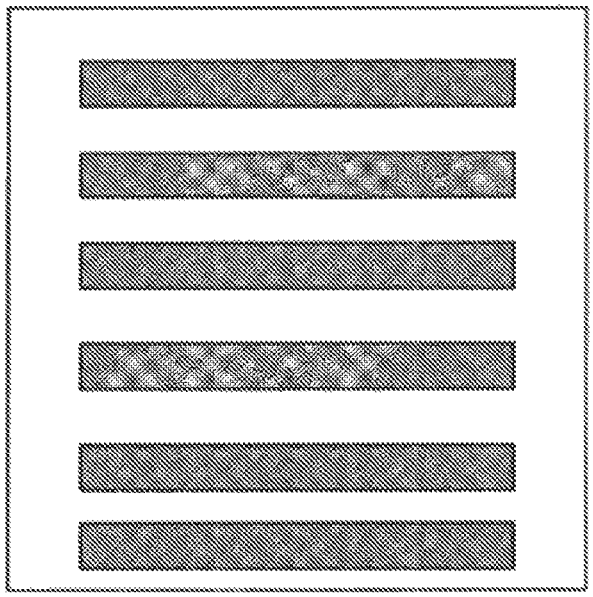
FIG. 9 is a diagram illustrating a half-chart formed in Experiment 1.

The inventors prepared a test machine having a configuration identical to that of the printer according to the present embodiment as illustrated in FIGS. 1 and 2. In this testing machine, 10,000 sheets and 50,000 sheets of a monochrome half chart (halftone gradation image) such as the one illustrated in FIG. 9 were continuously printed, under the below-described conditions, on A4 paper with a 50% image area ratio of horizontal stripes. Non-uniform charging in the photosensitive element 3Y was evaluated on the basis of print image results and magnified observation of the photosensitive element 3Y. Specifically, evaluation was graded into three categories, depending on the level of occurrence of white spots in the half chart: white spots (x), sparse white spots (Δ), and no white spots (O). In the evaluation of non-uniform charging, Δ and O were judged as allowable, while x was deemed to be a level that interferes with printing in practice.

The photosensitive element 3Y has a diameter of 24 mm and the surface potential having passed through the primary transfer nip is 0 V. The linear speed was 100 mm/s.

The charging roller 4Y used has a roller shape, with a shaft diameter of 6.0 mm and an outer diameter of 10.0 mm. As the charging bias applied to the charging roller 4Y there is applied a DC voltage of −500 V during a print job, and of −800 V during non-print job times. A charging brush roller in which plural flocked fibers are set standing on a rotating shaft member may be used as the charging member. The linear speed was 100 mm/s.

A −1100 V charging bias was applied to the charging roller (7K), while the photosensitive element 3K was uniformly charged at about −900 V. Although this potential is sustained up to just before advance into the primary transfer nip, the potential at the surface of the photosensitive element 3Y becomes attenuated to a potential of about −20 V after passing through the primary transfer nip, through the effect of the transfer current brought about in the primary transfer nip. The developing bias applied to the developing roller 42K was set to −250 V. The bias applied to the brush member 12K was set to −500 V.

As the bias applied to the cleaning brush 8Y there was used, to a duty of 45%, a bias in which an AC voltage of a peak-to-peak voltage $V_{pp}$ of 1.0 kV, with a frequency of 300 Hz during a print job and of 10 Hz during non-print job times, is superposed on a DC voltage Vdc of −900 V during a print job, and of −1500 V during non-print job times. By superposing an AC voltage onto a DC voltage, as in the present example, the toner can be imparted vibration electrically as a result of the changing polarity direction of the AC voltage. This facilitates detachment of toner from the charging roller 4Y, which increases as a result the recovery efficiency of toner on the charging roller 4Y by the cleaning brush 8Y. Imparting vibration electrically to the toner captured in the cleaning brush 8Y as a result of an AC voltage, as described above, during dumping of the toner captured in the cleaning brush 8Y to the charging roller 4Y and the cleaning auxiliary roller 9Y, has the effect of facilitating detachment of toner from the cleaning brush 8Y, thus affording an enhanced dumping efficiency.

Preferably, the frequency ranges herein from 5 Hz to 500 Hz. Ordinarily, applying for instance AC application voltage to the cleaning brush 8Y causes the potential of the charging roller 4Y to take on a central value of the AC application voltage, as the average situation between movement of toner from the charging roller 4Y to the cleaning brush 8Y and a movement of toner from the cleaning brush 8Y to the charging roller 4Y, within the region where the cleaning brush 8Y is in contact with the charging roller 4Y, as a result of the AC application voltage applied to the cleaning brush 8Y. Upon application of a low-frequency AC voltage, the surface potential of the charging roller 4Y is induced to a lower waveshape by the low-frequency of the cleaning brush 8Y, and the potential difference with the AC application voltage of the cleaning brush 8Y can be maintained as an average value. This allows toner to be effectively dumped from the cleaning brush 8Y to the charging roller 4Y. When the frequency is greater than 500 Hz, however, no surface potential waveshape forms on the charging roller 4Y, while at a frequency smaller than 5 Hz the waveshape is too short and the effect of the alternating current fails to be brought out, which precludes toner from being dumped with good efficiency.

As the cleaning brush 8Y there was used a roller-shaped brush having a diameter of 11 mm, in which plural flocked fibers that comprise nylon containing conductive particles are set standing on a rotating shaft member not shown. The allowable range of biting by the cleaning brush into the charging roller 4Y and the cleaning auxiliary roller 9Y was 0.1 to 1.0 mm. The linear speed during a print job was set to 250 mm/s, while during non-print job times, the ratio of linear speed of the cleaning brush 8Y relative to the linear speed of the charging roller 4Y and the linear speed of the cleaning auxiliary roller 9Y was set to range from 0.1 to 0.9.

A metal roller having a diameter of 11 mm is used as the cleaning auxiliary roller 9Y. To the cleaning auxiliary roller 9Y there is applied a DC voltage of −600 V during a print job, and of −1500 V during non-print job times. The linear speed was 100 mm/s.

Figure 10:
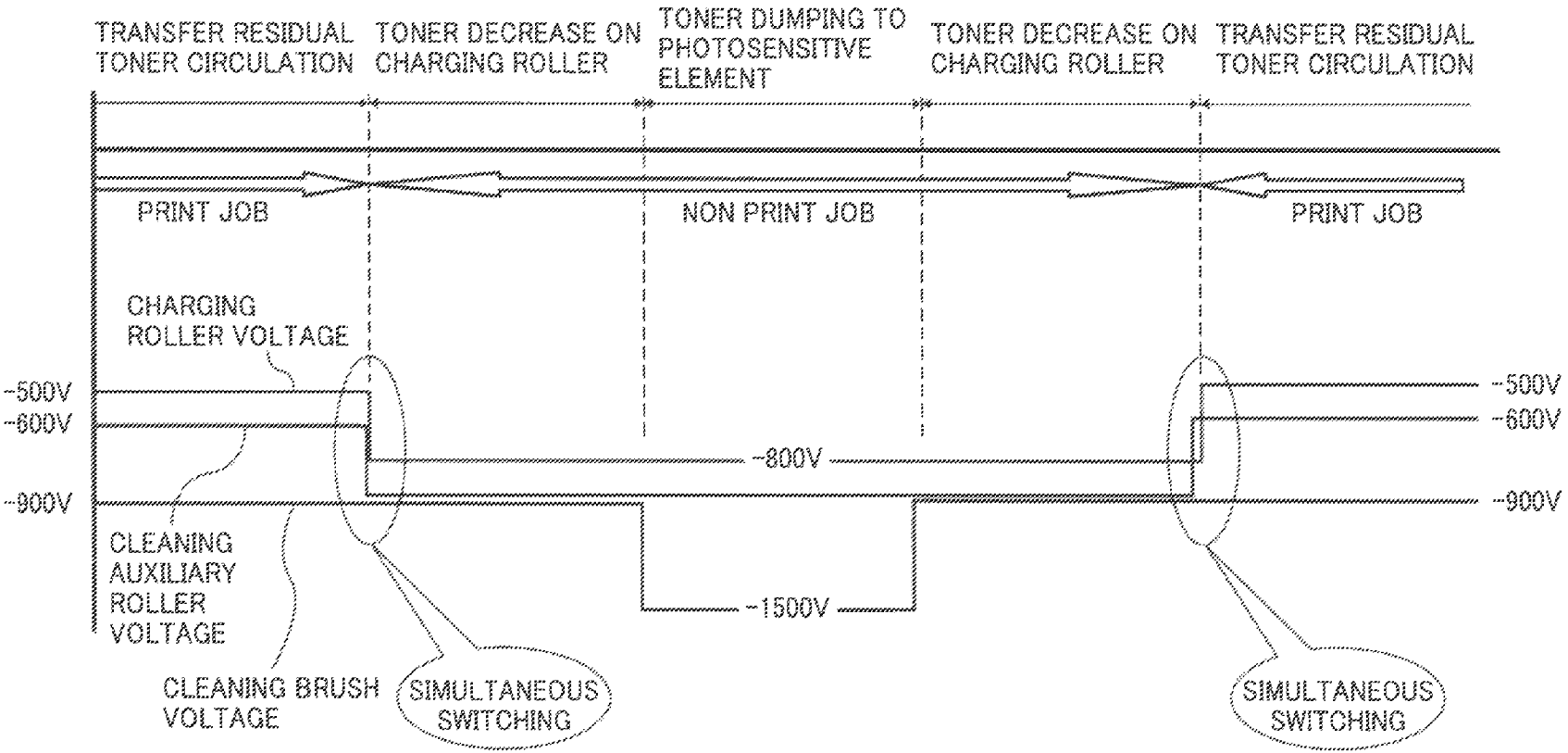
FIG. 10 is a diagram for explaining switching control of bias applied to respective members during a print job and during non print job times.

FIG. 10 illustrates switching control of the bias applied to the various members during a print job and during non-print job times.

During a print job, toner is recovered from the charging roller 4Y by the cleaning brush 8Y in such a way so as to eliminate toner as a cause of defective charging by the charging roller 4Y. Herein, bias is applied such that the toner recovered by the cleaning brush 8Y is caused to circulate between the cleaning brush 8Y, the cleaning auxiliary roller 9Y and the charging roller 4Y (in the present example, a bias such that the potential of the cleaning brush 8Y<potential of the cleaning auxiliary roller 9Y<potential of the charging roller 4Y).

Next, when the print job is over, the bias applied to the charging roller 4Y is modified as illustrated in FIG. 10, as a preparation for transferring the toner from the cleaning brush 8Y to the charging roller 4Y, in order to transfer the toner on the charging roller 4Y to the photosensitive element 3Y. The bias applied to the cleaning auxiliary roller 9Y is also modified at the same time as illustrated in FIG. 10. At the timing where no toner remains on the charging roller 4Y, bias is applied to the cleaning brush 8Y, as illustrated in FIG. 10, so that the toner on the cleaning brush 8Y becomes transferred to the charging roller 4Y. The toner transferred to the charging roller 4Y is transferred to the photosensitive element 3Y, and is recovered by the developing roller of the developing device.

Thereafter, for preparing recovery of transfer residual toner during a subsequent print job, firstly the toner on the charging roller 4Y is transferred to the cleaning brush 8Y by modifying the bias applied to the cleaning brush 8Y as illustrated in FIG. 10. With the charging roller 4Y thus cleaned, the bias applied to the charging roller 4Y and the cleaning auxiliary roller 9Y is modified as illustrated in FIG. 10.

A control unit not shown, comprising a CPU, a memory and the like, and provided in the printer main body, controls these application voltages applied to the various members.

In the experiment conducted under the above conditions, corresponding to Sample 1, the schematic configuration of the process unit 1Y during a print job was that illustrated in FIG. 3, while the schematic configuration of the process unit 1Y during non-print job times was that illustrated in FIG. 5. As a comparative control of Sample 1 there were conducted experiments for Samples 2 through 4 under the conditions below. Except for explicitly described conditions, the conditions below for the respective Samples were identical to those of Sample 1.

Sample 2

Voltage applied to the charging roller 4Y: −500 V during a print job, −800 V during non print job times Voltage applied to the cleaning brush 8Y: −900 V during a print job, −1500 V during non print job times Cleaning auxiliary roller 9Y: none Sample 3

Voltage applied to the charging roller 4Y: −400 V during a print job, −700 V during non print job times Voltage applied to the cleaning brush 8Y: −1000 V during a print job, −1600 V during non print job times Voltage applied to the cleaning auxiliary roller 9Y: −500 V during a print job, −900 V during non print job times Sample 4

Voltage applied to the charging roller 4Y: −500 V during a print job, −800 V during non print job times As the comprising member there was used cleaning roller comprising urethane foam on the outer periphery thereof.

Voltage applied to the cleaning roller: 900 V during a print job, −1500 V during non print job times Voltage applied to the cleaning auxiliary roller 9Y: −600 V during a print job, −900 V during non print job times The results of the tests carried out under the above conditions are illustrated in FIG. 16.

FIG. 16 indicates that in Samples 1, 3 and 4 the photosensitive element 3Y was charged well, without white spots. In Samples 1, 3 and 4 there is provided the cleaning auxiliary roller 9Y, such that toner recovered from the charging roller 4Y into the cleaning brush 8Y circulates between the cleaning brush 8Y, the cleaning auxiliary roller 9Y and the charging roller 4Y. As described above, this prevents excessive accumulation of toner in the cleaning brush 8Y, and hence allows preserving the cleaning performance of the cleaning brush 8Y during a print job. As a result, the cleaning brush 8Y is apt to clean well the charging roller 4Y during a print job that involves continuous printing of as many as 10,000 sheets, affording thus good charging of the photosensitive element 3Y by the charging roller 4Y.

During non-print job times, there is applied bias such that the transfer residual toner accumulated in the cleaning brush 8Y is transferred to the charging roller 4Y directly and via the cleaning auxiliary roller 9Y, while the toner transferred to the charging roller 4Y is further transferred to the photosensitive element 3Y. As a result, the transfer residual toner accumulated in the cleaning brush 8Y is transferred by electrostatic forces, with good efficiency, to the photosensitive element 3Y having a surface potential of 0 V, via the charging roller 4Y. During a print job, moreover, creeping of toner into the interior of the cleaning brush 8Y is restrained, so that toner can be transferred from the cleaning brush 8Y to the charging roller 4Y and the cleaning auxiliary roller 9Y, with no toner remaining in the cleaning brush 8Y, as described above. Thereby, the cleaning brush 8Y becomes clean preserving its cleaning performance. Therefore, the cleaning brush 8Y can arguably clean well the charging roller 4Y over long periods of time, while the transfer residual toner dumped to the photosensitive element 3Y is recovered at the developing device 40Y. As a result, the charging roller 4Y should afford good charging of the photosensitive element 3Y even during continuous printing of as many as 10,000 sheets.

As Samples 1 and 3 in FIG. 16 indicate, it is possible to charge well the photosensitive element 3Y during continuous printing of as many as 10,000 sheets even when the bias applied to the various members during a print job and during non-print job times is made to vary within a range that satisfies the above-described potential relationship between the various members of the present invention. That is, satisfying the above potential relationship should allow maintaining the cleaning brush 8Y clean and should allow the cleaning brush 8Y to clean the charging roller 4Y well.

Moreover, as Sample 4 in FIG. 16 shows, it was possible to charge the photosensitive element 3Y well, without white spots, even during continuous printing of as many as 50,000 sheets. Ostensibly, this resulted from using, as a cleaning member, a cleaning roller provided with a urethane foam outer periphery, whereby the frictional forces generated between the charging roller 4Y and the cleaning roller was greater than that when using the cleaning brush 8Y in the cleaning member, as described above. Thus, more toner could be recovered from the charging roller 4Y into the cleaning roller than was the case in Samples 1 and 3, which made it possible to clean well the charging roller 4Y and to charge well the photosensitive element 3Y even during continuous printing of as many as 50,000 sheets.

Figure 11:
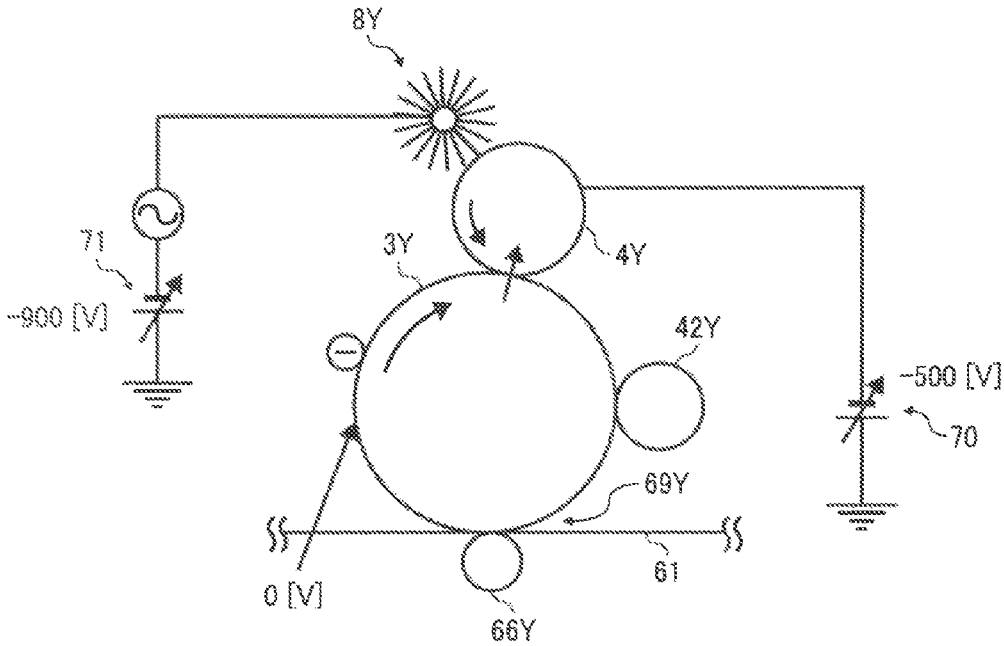
FIG. 11 is a diagram illustrating schematically the configuration of a process unit in Sample 2.

FIG. 11 illustrates the schematic configuration of the process unit 1Y in Sample 2. Sample 2 in FIG. 17 shows that charging of the photosensitive element 3Y was defective, with white spots appearing upon continuous printing of 10,000 sheets. Ostensibly, this resulted from the absence of the cleaning auxiliary roller 9Y in Sample 2, whereby the toner recovered from the charging roller 4Y into the cleaning brush 8Y during a print job went on accumulating in the cleaning brush 8Y. Thus, when halfway during the print job the toner accumulation level in the cleaning brush 8Y exceeds a limit, the cleaning performance of the cleaning brush 8Y becomes impaired, and the charging roller 4Y cannot be cleaned well. As a result, the charging roller 4Y fails to charge well the photosensitive element 3Y during the print job.

Also, excessive accumulation of toner in the cleaning brush 8Y upon image forming ostensibly results in toner creeping from around the end of the cleaning brush 8Y into the interior of the brush during non-print job times. Thereupon, the toner remains in the cleaning brush 8Y, without migrating to the charging roller 4Y and the cleaning auxiliary roller 9Y from the cleaning brush 8Y as a result of electrostatic forces, as described above. Through continuous printing, therefore, toner goes on accumulating gradually in the cleaning brush 8Y, eliciting in a short time loss of cleaning performance by the cleaning brush 8Y. Whether during a print job or during non-print job times, the cleaning performance of the cleaning brush 8Y becomes thus impaired, so that, halfway through the continuous printing of 10,000 sheets, the cleaning brush 8Y fails to clean well the charging roller 4Y, giving rise to deficient charging where the charging roller 4Y fails to charge well the photosensitive element 3Y.

Figure 12:
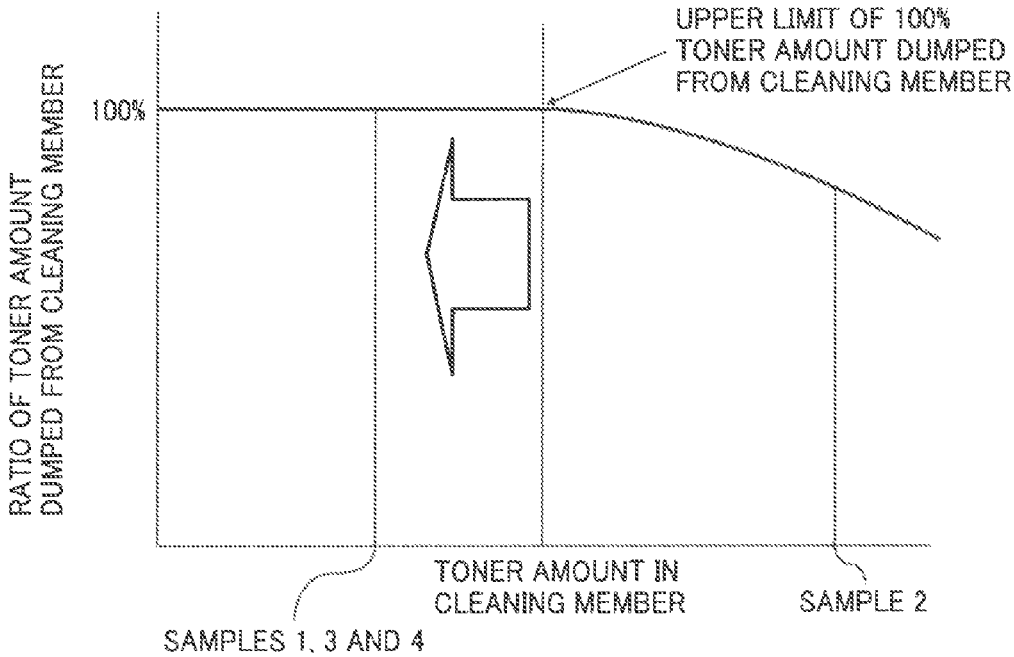
FIG. 12 is a diagram for explaining the ratio relationship between amount of toner dumping and amount of toner in a cleaning brush.

The above-described limit of the toner accumulation level in the cleaning brush 8Y, which is the limit depicted in FIG. 12, denotes a limit such that if the toner accumulated in the cleaning brush 8Y during a print job is smaller than the limit, then 100% of the toner accumulated in the cleaning brush 8Y can be transferred to the charging roller 4Y and the cleaning auxiliary roller 9Y during non-print job times.

In Samples 1, 3 and 4, toner is made to circulate between the cleaning brush 8Y, the cleaning auxiliary roller 9Y and the charging roller 4Y during a print job, whereby the amount of toner accumulated in the cleaning brush 8Y can be kept smaller than the limit depicted in FIG. 12. Thereby, 100% of the toner accumulated in the cleaning brush 8Y can be transferred to the charging roller 4Y and the cleaning auxiliary roller 9Y during non-print job times, which allows restoring the cleaning performance of the cleaning brush 8Y.

In Sample 2, the toner recovered in the cleaning brush 8Y from the charging roller 4Y during a print job goes on accumulating in the cleaning brush 8Y, so that the amount of toner accumulated in the cleaning brush 8Y exceeds eventually the limit illustrated in FIG. 12. Therefore, as illustrated in FIG. 12, toner accumulated in the cleaning brush 8Y fails to be 100% transferred to the charging roller 4Y and the cleaning auxiliary roller 9Y during non-print job times, with toner remaining as a result in the cleaning brush 8Y. Toner accumulates gradually thus in the cleaning brush 8Y as printing progresses, which soon ends up impairing the cleaning performance of the cleaning brush 8Y.

EXAMPLE 2

A printer according to Example 2 is explained next. Unless specified otherwise, the configuration of the printer according to Example 2 is identical to that of the embodiment.

Figure 13:
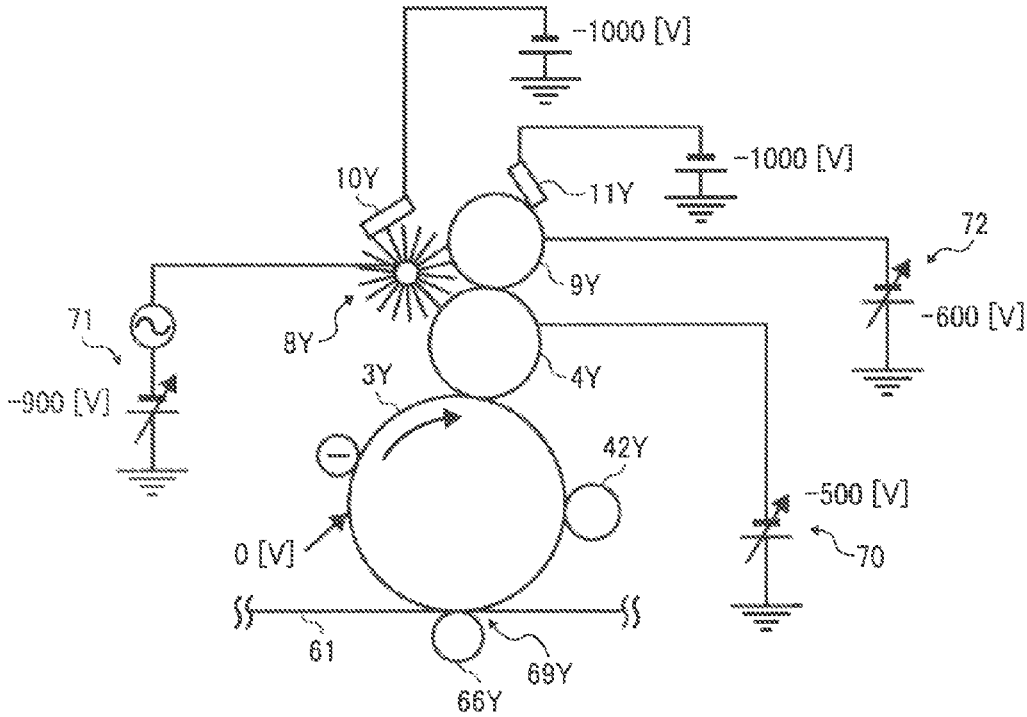
FIG. 13 is a diagram illustrating schematically the configuration of a process unit during a print job in Example 2.

FIG. 13 illustrates a process unit 1Y for Y in the printer according to Example 2. The process units 1M, 1C, 1K for the other colors have the same configuration as that for Y.

In the present Example 2 there is used a temporary capture cleanerless method, as in Example 1. The basic configuration of the apparatus main body in Example 2 and Example 1 are identical. In Example 2, however, the apparatus main body is provided, in addition to the configuration of Example 1, with a conductive sheet 10Y and a conductive sheet 11Y, comprising a conductive sheet and being cantilever-supported in such a way that the free end side of the conductive sheet 10Y abuts the cleaning brush 8Y, while that of the conductive sheet 11Y abuts the cleaning auxiliary roller 9Y, as illustrated in FIG. 13. A charging pre-bias supply means comprising a power supply, wiring and the like, and provided in the apparatus main body, supplies charging pre-bias comprising DC voltage to the conductive sheet 10Y and the conductive sheet 11Y having the above configurations. The base material resin of the conductive sheet 10Y and the conductive sheet 11Y may be, for instance, polyvinylidene fluoroethylene (PVDF), nylon, polytetrafluoroethylene (PTFE), urethane, polyethylene, or a mixture of two or more of the foregoing. In Example 2, a negative charging pre-bias is applied to the conductive sheet 10Y and the conductive sheet 11Y, as a result of which the transfer residual toner captured in the cleaning brush 8Y and the cleaning auxiliary roller 9Y becomes uniformly charged with identical amounts of negative charge that is herein the regular polarity. The dumping efficiency with which transfer residual toner is dumped by electrostatic forces from the cleaning brush 8Y and the cleaning auxiliary roller 9Y to the charging roller 4Y can be enhanced when the charge amount of the transfer residual toner is not smaller than a certain level. Accordingly, causing the transfer residual toner, charged with reverse polarity and/or having the charge amount reduced on account of the primary transfer, to be uniformly charged with a regular polarity and identical charge amount, through the action of the conductive sheet 10Y and the conductive sheet 11Y, allows effecting dumping transfer residual toner from the cleaning brush 8Y and the cleaning auxiliary roller 9Y to the charging roller 4Y more efficiently than is the case when no conductive sheet 10Y or conductive sheet 11Y abut the cleaning brush 8Y and/or the cleaning auxiliary roller 9Y.

During periods in which no electrostatic latent image is formed by the writing means, such as when a print job is over, at timings between papers or the like, the transfer residual toner captured in the cleaning brush 8Y is transferred from the cleaning brush 8Y to the charging roller 4Y directly, or via the cleaning auxiliary roller 9Y, and the transfer residual toner transferred to the charging roller 4Y is transferred to the photosensitive element 3Y, by switching the charging bias applied to the cleaning brush 8Y from a superposed voltage to a DC voltage. In Example 2, the transfer residual toner captured in the cleaning brush 8Y and the cleaning auxiliary roller 9Y is uniformly charged to regular negative polarity and to identical charge amount, through the action of the conductive sheet 10Y and the conductive sheet 11Y. As a result, the transfer residual toner is dumped efficiently, by electrostatic forces, from the charging roller 4Y to the photosensitive element 3Y, during re-transfer of transfer residual toner from the charging roller 4Y to the photosensitive element 3Y. The transfer residual toner re-transferred onto the photosensitive element 3Y is recovered from the photosensitive element 3Y into the developing device 40Y via the developing roller 42Y. Since the transfer residual toner is uniformly charged to regular negative polarity and identical charge amount through the action of the conductive sheet 10Y and the conductive sheet 11Y, there is prevented moreover the occurrence of scumming caused by reversely-charged toner or low-charge toner in the transfer residual toner arriving at the developing area.

In the present example the conductive sheet 10Y abuts the cleaning brush 8Y and the conductive sheet 11Y abuts the cleaning auxiliary roller 9Y. The example, however, is not limited thereto, and may comprise a conductive sheet abutting at least one among the cleaning brush 8Y and the cleaning auxiliary roller 9Y. That is because the transfer residual toner recovered from the photosensitive element 3Y onto the charging roller 4Y circulates between the charging roller 4Y, the cleaning brush 8Y and the cleaning auxiliary roller 9Y, and hence charging of the transfer residual toner, through a conductive sheet, on at least one among the cleaning brush 8Y and the cleaning auxiliary roller 9Y, results in the whole of the transfer residual toner being uniformly charged over time.

In addition to toner charged with regular charge polarity, the transfer residual toner adhered to the surface of the photosensitive element 3K having passed through the primary transfer nip comprises as well, for instance, low-charge toner, which although charged with regular charge polarity, exhibits an insufficient charge amount, and also reversely-charged toner, which is charged to an inverse polarity. As the photosensitive element 3K rotates, such a transfer residual toner enters into an auxiliary charging nip. Thereupon, the reversely-charged toner in the transfer residual toner becomes sufficiently charged with regular negative polarity through electric discharge between an auxiliary charging member 10K and the photosensitive element 3K, or through charge injection by the auxiliary charging member 10K. The low-charge toner in the transfer residual toner becomes also sufficiently charged with negative polarity through electric discharge or through charge injection. This suppresses occurrence of scumming caused by reversely-charged toner and/or low-charge toner in the transfer residual toner being transported to the developing area.

EXAMPLE 3

A printer according to Example 3 is explained next. Unless specified otherwise, the configuration of the printer according to Example 3 is identical to that of the embodiment.

Figure 14:
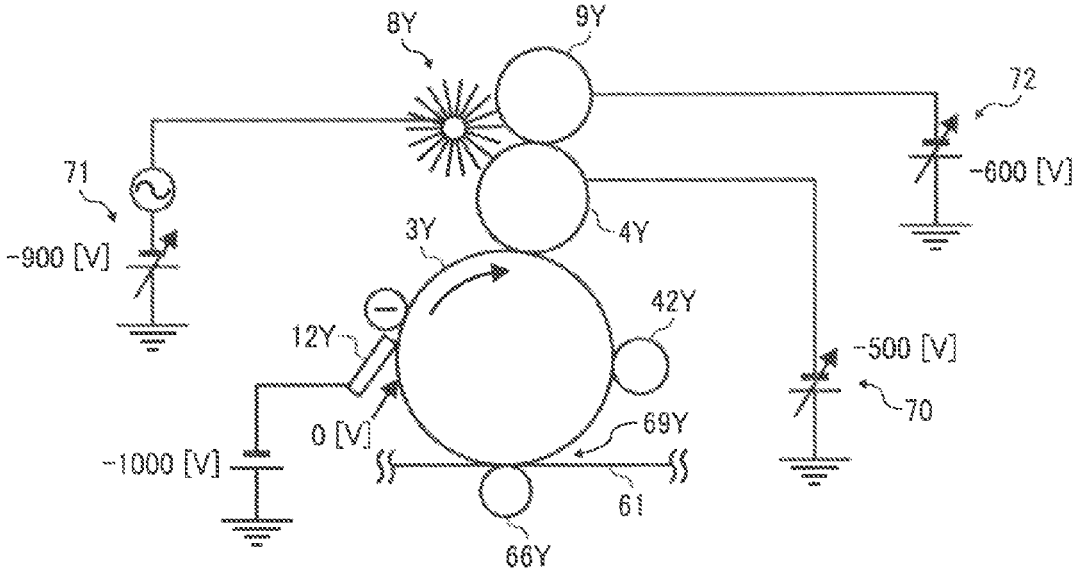
FIG. 14 is a diagram illustrating schematically the configuration of a process unit during a print job in Example 3.

FIG. 14 is an enlarged schematic diagram illustrating the process unit 1Y for Y in the printer according to Example 3. The process units 1M, 1C, 1K for the other colors have the same configuration as that for Y.

In Example 3 there is used a temporary capture cleanerless method, as in Examples 1 and 2. The basic configuration of the apparatus main body in Example 3 is identical to that of Examples 1 and 2. In Example 3, however, a conductive sheet 12Y abuts the surface of the photosensitive element 3Y more upstream in the rotation direction of the photosensitive element than the charging roller 4Y, as illustrated in FIG. 14. In Example 3, the characteristics of the conductive sheet 12Y used, the bias applied by the charging pre-bias supply means and the like are identical to those of Example 2. The conductive sheet 12Y allows turning the polarity of the transfer residual toner charged positively, as a reverse polarity, on the photosensitive element 3Y, to regular negative polarity and allows increasing the charge amount of low-charge toner. Uniformly charging thus the transfer residual toner on the photosensitive element 3Y to a regular negative polarity and identical charge amount facilitates capture of the transfer residual toner by the cleaning brush 8Y to which positive bias is applied, as illustrated in FIG. 14, with the transfer residual toner being transferred to the cleaning brush 8Y where it is captured.

During periods such as when a print job is over, at timings between papers or the like, the transfer residual toner captured in the cleaning brush 8Y is transferred from the cleaning brush 8Y to the charging roller 4Y, directly or via the cleaning auxiliary roller 9Y, and thereafter from the charging roller 4Y to the photosensitive element 3Y, by switching the charging bias applied to the cleaning brush 8Y from a superposed voltage to a DC voltage. The transfer residual toner is recovered from the photosensitive element 3Y to the developing device 40Y via the developing roller 42Y. The transfer residual toner captured in the cleaning brush 8Y has been charged uniformly by the conductive sheet 12Y to regular negative charge and identical charge amount, prior to being captured by the cleaning brush 8Y, and hence the transfer residual toner can be dumped with good efficiency from the cleaning brush 8Y to the charging roller 4Y and the cleaning auxiliary roller 9Y during the above re-transfer, as described in Example 2. Since the transfer residual toner is charged uniformly by the conductive sheet 12Y to a negative charge, which is the regular polarity, and with an identical charge amount, there is prevented moreover the occurrence of scumming caused by reversely-charged toner or low-charge toner in the transfer residual toner arriving at the developing area, as was the case in Example 2.

In addition to toner charged with regular charge polarity, the transfer residual toner adhered to the surface of the photosensitive element 3K having passed through the primary transfer nip comprises as well, for instance, low-charge toner, which although charged with regular charge polarity, exhibits insufficient charge amount, and also reversely-charged toner, which is charged to an inverse polarity. As the photosensitive element 3K rotates, such a transfer residual toner enters into an auxiliary charging nip. Thereupon, the reversely-charged toner in the transfer residual toner becomes sufficiently charged with regular negative polarity through electric discharge between an auxiliary charging member 10K and the photosensitive element 3K, or through charge-injection from by the auxiliary charging member 10K. The low-charge toner in the transfer residual toner becomes also sufficiently charged with negative polarity through electric discharge or through charge injection. This suppresses occurrence of scumming caused by reversely-charged toner and/or low-charge toner in the transfer residual toner being transported to the developing area.

In the present embodiment, a printer as an image forming apparatus comprises a photosensitive element 3, which is a latent image carrier carrying a latent image on an endlessly moving own surface; a developing device 40, which is a means for developing the latent image on the photosensitive element 3; a charging roller 4, being a charging member for charging uniformly the surface of the photosensitive element 3 while an own surface is moved endlessly in contact with the photosensitive element 3; a power supply device 70 being a first bias supply means, for supplying bias to the charging roller 4; a cleaning brush 8, being a first cleaning member for cleaning the surface of the charging roller 4, by recovering at least toner adhered to the surface of the charging roller 4 while an own surface is moved endlessly in contact with the charging roller 4; and a power supply device 71 being a second bias supply means, for supplying bias to the cleaning brush 8; the printer having also a cleaning auxiliary roller 9, being a second cleaning member for recovering at least toner from the cleaning brush 8 while an own surface is moved endlessly in contact with the charging roller 4 and the cleaning brush 8; and a power supply device 72 being a third bias supply means, for supplying bias to the cleaning auxiliary roller 9. In the printer, the power supply device 70 supplies bias to the charging roller 4, and the power supply device 72 supplies bias to the cleaning auxiliary roller 9, in such a way that toner recovered in the cleaning auxiliary roller 9 is transferred by electrostatic forces to the charging roller 4, to transfer thereby toner from the cleaning auxiliary roller 9 to the charging roller 4; also, the power supply device 70 supplies bias to the charging roller 4 and the power supply device 71 supplies bias to the cleaning brush 8 in such a way that toner recovered in the cleaning brush 8 is transferred, through electrostatic forces, from the cleaning brush 8 directly to the charging roller 4, to transfer thereby toner from the cleaning brush 8 to the charging roller 4, and/or the power supply device 70 supplies bias to the charging roller 4, the power supply device 71 supplies bias to the cleaning brush 8 and the power supply device 72 supplies bias to the cleaning auxiliary roller 9 in such a way that the toner is transferred from the cleaning brush 8 to the charging roller 4 via the cleaning auxiliary roller 9, to transfer thereby toner from the cleaning brush 8 to the charging roller 4. Further, the toner transferred to the charging roller 4 is transferred to a non-image area on the photosensitive element 3, such that the toner transferred to the non-image area is recovered at the developing device 40.

During a print job, as a result, toner recovered from the charging roller 4 into the cleaning brush 8 is transferred from the cleaning brush 8 to the cleaning auxiliary roller 9, thereby preventing excessive accumulation of toner in the cleaning brush 8. This allows forestalling loss of cleaning performance by the cleaning brush 8 halfway during a print job, and affords hence both good cleaning of the charging roller 4 by the cleaning brush 8 and good charging of the photosensitive element 3 by the charging roller 4 during a print job.

During non-print job times, there is applied bias such that the toner accumulated in the cleaning brush 8 is transferred to the charging roller 4 directly and via the cleaning auxiliary roller 9, while the toner transferred to the charging roller 4 is further transferred to the photosensitive element 3. As a result, transfer residual toner accumulated in the cleaning brush 8 is shifted by electrostatic forces to the charging roller 4, directly or via the cleaning auxiliary roller 9, with good efficiency.

During a print job, moreover, creeping of toner into the interior of the cleaning brush 8 is restrained, so that toner can be transferred from the cleaning brush 8 to the charging roller 4 and the cleaning auxiliary roller 9Y with no toner remaining in the cleaning brush 8, as described above. Thereby, the cleaning brush 8 becomes clean preserving its cleaning performance. The cleaning brush 8 cleans also well, as a result, the charging roller 4 over an extended period of time, which enables in turn good long-term charging of the photosensitive element 3 by the charging roller 4Y.

Also, the transfer residual toner dumped to the photosensitive element 3 is recovered at the developing device 40, which does away with the need for a dedicated recovery toner holding portion for recovering transfer residual toner, thereby reducing effectively the size of the apparatus main body.

In the present embodiment, the toner is negatively charged. During a print job, when toner is not transferred to the non-image area, the power supply device 71 and the power supply device 72 vary the bias applied to the cleaning brush 8 and the cleaning auxiliary roller 9, affording a variable potential difference between the cleaning brush 8 and the cleaning auxiliary roller 9. Also, the power supply device 70 and the power supply device 72 supply bias to the charging roller 4 and the cleaning auxiliary roller 9 in such a way that the potential of the charging roller 4 is higher than the potential of the cleaning auxiliary roller 9. During non-print job times, i.e. when toner is transferred to the non-image area, the power supply device 70, the power supply device 71 and the power supply device 72 supply bias to the charging roller 4, the cleaning brush 8 and the cleaning auxiliary roller 9 in such a way that the potential of the cleaning brush 8, the potential of the cleaning auxiliary roller 9, the potential of the charging roller 4 and the potential of the photosensitive element 3 satisfy the relationship: potential of the cleaning brush 8<potential of the cleaning auxiliary roller 9<potential of the charging roller 4<potential of the photosensitive element 3.

This allows the negatively-charged toner to be transferred by electrostatic forces to predefined members, with good efficiency, depending on the situation.

During a print job in the present embodiment, toner adhered to the photosensitive element 3 is transferred from the photosensitive element 3 to the charging roller 4 through frictional forces generated at the contact portion between the charging roller 4 and the photosensitive element 3, while toner adhered to the charging roller 4 is transferred from the charging roller 4 to the cleaning brush 8 through frictional forces generated at the contact portion between the charging roller 4 and the cleaning brush 8. This allows scraping toner off mechanically by frictional forces that exceed electrostatic forces even when, depending on the relationship of the bias applied to the various members, such electrostatic forces fail to cause toner to be transferred from the photosensitive element 3 to the charging roller 4, and from the charging roller 4 to the cleaning brush 8.

In the present embodiment, the power supply device 71 applies to the cleaning brush 8 a bias in which AC voltage is superposed to DC voltage. This imparts vibration electrically to the toner adhered to the charging roller 4 and the toner adhered to the cleaning brush 8, in accordance with the characteristic of the AC voltage. This makes it easier, as a result, for the toner to detach from the respective members, and allows enhancing the efficiency with which toner is recovered from the charging roller 4 to the cleaning brush 8, and the efficiency with which the toner is dumped from the cleaning brush 8 to the charging roller 4 and the cleaning auxiliary roller 9, as compared with a case where AC voltage alone is applied to the cleaning brush 8.

In the present embodiment, the frequency of the above AC voltage ranges from 5 Hz to 500 Hz. At a frequency smaller than 5 Hz, for which waveshape is too short, the AC effect fails to be brought out, while at a frequency greater than 500 Hz, there forms a surface potential waveshape at the photosensitive element 3, which precludes toner from being dumped with good efficiency. Accordingly, toner can be dumped with good efficiency from the cleaning brush 8 to the charging roller 4 and the cleaning auxiliary roller 9Y by setting a frequency of 5 Hz to 500 Hz, as in the present embodiment.

In the present embodiment, the rotation direction of the cleaning brush 8 is the same as the rotation direction of the charging roller 4. Hence, the cleaning brush 8 rotates in a direction counter to the rotation of the charging roller 4. This elicits as a result large frictional forces that allow recovering toner from the charging roller 4 to the cleaning brush 8.

In the present embodiment, the ratio of linear speed of the cleaning brush 8 relative to the linear speed of the charging roller 4 and the linear speed of the cleaning auxiliary roller 9 is of 0.1 to 0.9. When the above linear speed ratio is smaller than 0.1, the toner captured in the cleaning brush 8 is substantially dumped at the same location alone, while when the linear speed ratio is greater than 0.9, the cleaning brush 8 rotates excessively fast, which results in a shorter time of dumping of toner from the cleaning brush 8. Accordingly, setting a linear speed ratio of 0.1 to 0.9, as in the present embodiment, allows hence toner to be dumped from the cleaning brush 8 to the charging roller 4 and the cleaning auxiliary roller 9 with good efficiency.

When in the present embodiment the above cleaning member is a roller-shaped cleaning member having an elastic member on the outer periphery thereof, during recovery of toner from the charging roller 4 to the cleaning roller by, for instance, frictional forces in addition to electrostatic forces, the cleaning roller and the charging roller 4 must come into contact to such an extent that the surface of the cleaning roller collapses through elastic deformation, affording thereby large frictional forces that allow recovering toner from the charging roller 4 to the cleaning brush 8 with good efficiency.

When using urethane foam as the elastic member in the present embodiment, the irregularities in the surface of the urethane foam facilitate scraping of toner off the photosensitive element 3 and the charging roller 4.

In the present embodiment, making the above cleaning member into a brush-like cleaning brush 8 allows scraping toner effectively off the charging roller 4 into the cleaning brush 8, as a result of the friction of the brush against the charging roller 4.

In the present embodiment, the cleaning brush 8 is detachably provided in the apparatus main body. This allows replacing the cleaning brush 8 with a new one, thereby affording good cleaning by the charging roller 4.

In the present embodiment, there is provided at least one among a conductive sheet 10 as a first toner charging means, coming into contact with the cleaning brush 8, for charging the toner recovered to the cleaning brush 8, and a conductive sheet 11 as a second toner charging means, coming into contact with the cleaning auxiliary roller 9, for charging the toner recovered to the cleaning auxiliary roller 9. This allows charging uniformly, to a regular polarity and identical charge amount, the toner captured in the cleaning brush 8 and the cleaning auxiliary roller 9, as a result of which toner can be dumped by electrostatic forces from the cleaning brush 8 and the cleaning auxiliary roller 9 to charging roller 4 with good efficiency.

The present embodiment comprises also a primary transfer portion 69, which is a transfer portion for transferring a toner image on the photosensitive element 3 to a transfer material, and a conductive sheet 12, as a toner charging means, provided more upstream in the rotation direction of the photosensitive element 3 than the position at which the charging roller 4 and the photosensitive element 3 abut each other, for charging toner adhered to the surface of the photosensitive element 3 between the charging roller 4 and the primary transfer portion 69. The transfer residual toner captured in the cleaning brush 8 is charged thus uniformly, to a regular polarity and identical charge amount, by the conductive sheet 12 prior to being captured by the cleaning brush 8, and hence the transfer residual toner can be dumped with good efficiency from the cleaning brush 8 to the charging roller 4 and the cleaning auxiliary roller 9.

In the present embodiment there is used, as a developer, a one-component developer having a main component of negatively-chargeable toner, but there may also be used a one-component developer having a main component of positively-chargeable toner. In that case, the bias applied to the various members need only be of a polarity inverse to that when negatively-chargeable toner is used. The present embodiment is not limited to a one-component developer, and a two-component developer comprising toner and a carrier may also be used herein.

The superior effects afforded by the present invention include thus preserving the cleaning performance of a cleaning brush over time while reducing the size of an apparatus main body.

Various modifications will become possible for those skilled in the art after receiving the teachings of the present disclosure without departing from the scope thereof.

What is claimed is:

1. An image forming apparatus, comprising:

a latent image carrier for carrying a latent image on an endlessly moving surface thereof;

developing means for developing with toner a latent image on the latent image carrier;

a charging member for uniformly charging a surface of the latent image carrier while the surface thereof in contact with the latent image carrier is moved endlessly;

first bias supply means for supplying bias to the charging member;

a first cleaning member for cleaning a surface of the charging member by recovering at least toner adhered to the surface of the charging member while the surface thereof in contact with the latent charging member is moved endlessly;

second bias supply means for supplying bias to the first cleaning member;

a second cleaning member for recovering toner at least from the first cleaning member while the surface thereof in contact with the charging member and the first cleaning member is moved endlessly; and third bias supply means for supplying bias to the second cleaning member, wherein the first bias supply means supplies bias to the charging member, and the third bias supply means supplies bias to the second cleaning member, in such a way that toner recovered in the second cleaning member is transferred by electrostatic forces to the charging member, to transfer thereby toner from the second cleaning member to the charging member;

the first bias supply means supplies bias to the charging member and the second bias supply means supplies bias to the first cleaning member in such a way that toner recovered in the first cleaning member is transferred by electrostatic forces, from the first cleaning member directly to the charging member, to transfer thereby toner from the first cleaning member to the charging member, and/or the first bias supply means supplies bias to the charging member, the second bias supply means supplies bias to the first cleaning member, and the third bias supply means supplies bias to the second cleaning member in such a way that toner is transferred from the first cleaning member to the charging member via the second cleaning member, to transfer thereby toner from the first cleaning member to the charging member; and wherein toner transferred to the charging member is transferred to a non-image area on the latent image carrier, such that the toner transferred to the non-image area is recovered by the developing means.

2. The image forming apparatus as claimed in claim 1, wherein toner is negatively charged, and when toner is not transferred to the non-image area, the second bias supply means and the third bias supply means vary the bias applied to the first cleaning member and the second cleaning member yielding a variable potential difference between the first cleaning member and the second cleaning member, and the first bias supply means and the third bias supply means supply bias to the charging member and the second cleaning member in such a way that the potential of the charging member is higher than the potential of the second cleaning member, while upon transfer of toner to the non-image area, the first bias supply means, the second bias supply means, and the third bias supply means supply bias to the charging member, the first cleaning member, and the second cleaning member in such a way that the potential of the first cleaning member, the potential of the second cleaning member, the potential of the charging member and the potential of the latent image carrier satisfy a relationship: the potential of the first cleaning member<potential of the second cleaning member<potential of the charging member<potential of the latent image carrier.

3. The image forming apparatus as claimed in claim 1, wherein when toner is not transferred to the non-image area, toner adhered to the latent image carrier is transferred from the latent image carrier to the charging member through frictional forces generated at a contact portion between the charging member and the latent image carrier, while toner adhered to the charging member is transferred from the charging member to the first cleaning member through frictional forces generated at a contact portion between the charging member and the first cleaning member.

4. The image forming apparatus as claimed in claim 1, wherein the second bias supply means applies to the first cleaning member bias in which AC voltage is superposed to DC voltage.

5. The image forming apparatus as claimed in claim 4, wherein the frequency of the AC voltage is 5 Hz to 500 Hz.

6. The image forming apparatus as claimed in claim 1, wherein a rotation direction of the first cleaning member is the same as a rotation direction of the charging member.

7. The image forming apparatus as claimed in claim 1, wherein, upon transfer of toner to the non-image area, the ratio of linear speed of the first cleaning member relative to the linear speed of the charging member and the linear speed of the second cleaning member is 0.1 to 0.9.

8. The image forming apparatus as claimed in claim 1, wherein the first cleaning member is shaped as a roller comprising an elastic member on the outer periphery thereof.

9. The image forming apparatus as claimed in claim 8, wherein the elastic member is urethane foam.

10. The image forming apparatus as claimed in claim 1, wherein the first cleaning member has a brush shape.

11. The image forming apparatus as claimed in claim 1, wherein the first cleaning member is detachably provided in an apparatus main body.

12. The image forming apparatus as claimed in claim 1, further comprising at least one of first toner charging means, coming into contact with the first cleaning member, for charging toner recovered at the first cleaning member, and second toner charging means, coming into contact with the second cleaning member, for charging toner recovered at the second cleaning member.

13. The image forming apparatus as claimed in claim 1, further comprising:

a transfer portion for transferring a toner image on the latent image carrier to a transfer material; and toner charging means provided more upstream in the rotation direction of the latent image carrier than a position at which the charging member and the latent image carrier abut each other, for charging toner adhered to the surface of the latent image carrier between the charging member and the transfer portion.

14. An image forming apparatus, comprising:

a latent image carrier configured to carry a latent image on an endlessly moving surface thereof;

a developing device configured to develop with toner a latent image on the latent image carrier;

a charging member configured to uniformly charge a surface of the latent image carrier while the surface thereof in contact with the latent image carrier is moved endlessly;

a first bias supply device configured to supply bias to the charging member;

a first cleaning member configured to clean a surface of the charging member by recovering at least toner adhered to the surface of the charging member while the surface thereof in contact with the latent charging member is moved endlessly;

a second bias supply device configured to supply bias to the first cleaning member;

a second cleaning member configured to recover toner at least from the first cleaning member while the surface thereof in contact with the charging member and the first cleaning member is moved endlessly; and a third bias supply device configured to supply bias to the second cleaning member, wherein the first bias supply device supplies bias to the charging member, and the third bias supply device supplies bias to the second cleaning member, in such a way that toner recovered in the second cleaning member is transferred by electrostatic forces to the charging member, to transfer thereby toner from the second cleaning member to the charging member;

the first bias supply device supplies bias to the charging member and the second bias supply device supplies bias to the first cleaning member in such a way that toner recovered in the first cleaning member is transferred by electrostatic forces, from the first cleaning member directly to the charging member, to transfer thereby toner from the first cleaning member to the charging member, and/or the first bias supply device supplies bias to the charging member, the second bias supply device supplies bias to the first cleaning member, and the third bias supply device supplies bias to the second cleaning member in such a way that toner is transferred from the first cleaning member to the charging member via the second cleaning member, to transfer thereby toner from the first cleaning member to the charging member; and wherein toner transferred to the charging member is transferred to a non-image area on the latent image carrier, such that the toner transferred to the non-image area is recovered by the developing device.

* * * * *